US009427957B2

(12) United States Patent
Abe et al.

(10) Patent No.: US 9,427,957 B2
(45) Date of Patent: Aug. 30, 2016

(54) LIQUID EJECTING APPARATUS, HEAD UNIT, AND METHOD OF CONTROLLING LIQUID EJECTING APPARATUS

(71) Applicant: Seiko Epson Corporation, Tokyo (JP)

(72) Inventors: Akira Abe, Matsumoto (JP); Hiroshi Sugita, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/656,890

(22) Filed: Mar. 13, 2015

(65) Prior Publication Data

US 2015/0273821 A1 Oct. 1, 2015

(30) Foreign Application Priority Data

Mar. 25, 2014 (JP) ..... 2014-061521

(51) Int. Cl.
*B41J 2/045* (2006.01)
*B41J 2/14* (2006.01)

(52) U.S. Cl.
CPC ..... *B41J 2/04541* (2013.01); *B41J 2/04581* (2013.01); *B41J 2/04588* (2013.01); *B41J 2/04593* (2013.01); *B41J 2/04596* (2013.01); *B41J 2/14233* (2013.01); *B41J 2002/14491* (2013.01)

(58) Field of Classification Search
CPC ..... B41J 2/04541; B41J 2/04581; B41J 2/04588; B41J 2/04593; B41J 2/04596
USPC ..... 347/9–12
See application file for complete search history.

(56) References Cited

U.S. PATENT DOCUMENTS 5,075,701 A * 12/1991 Arai ..... B41J 2/345 347/182
8,222,718 B2 * 7/2012 Jereza ..... H01L 23/492 257/676
2009/0206888 A1 8/2009 Kitazawa et al.
2011/0242172 A1 * 10/2011 Yoshino ..... B41J 2/04541 347/10

FOREIGN PATENT DOCUMENTS

JP 2009-190287 A 8/2009
JP 2010-114711 A 5/2010

* cited by examiner

*Primary Examiner* — Jason Uhlenhake
(74) *Attorney, Agent, or Firm* — Harness, Dickey & Pierce, P.L.C.

(57) ABSTRACT

A liquid ejecting apparatus includes: a modulation circuit that generates a modulated signal obtained by performing pulse modulation on a source signal; a transistor that amplifies the modulated signal to generate an amplified modulated signal; a lowpass filer that smoothes the amplified modulated signal to generate a driving signal; a piezoelectric element that is displaced when the driving signal is applied; and a circuit substrate on which the modulation circuit, the transistor, and the lowpass filter are mounted. The transistor includes a die, a first electrode, a second electrode, a third electrode, a conductive die pad, a first lead which is electrically connected to the second electrode by a bonding wire, and a second lead which is electrically connected to the third electrode by a bonding wire. The die pad, the first lead, and the second lead are electrically connected to different wiring patterns of the circuit substrate.

6 Claims, 19 Drawing Sheets

<DECODING CONTENTS OF DECODER>

| PRINTING DATA Data | T1 | | T2 | |
|---|---|---|---|---|
| | Sa | Sb | Sa | Sb |
| (1, 1) | H | L | H | L |
| (0, 1) | H | L | L | H |
| (1, 0) | L | L | L | H |
| (0, 0) | L | H | L | L |

MSB LSB

FIRST LAYER SURFACE (CONDUCTIVE LAYER)

<SECOND LAYER>

<THIRD LAYER>

<FOURTH LAYER>

<DISPOSITION OF ELEMENTS>

<EQUIVALENT CIRCUIT>

<ASSIGNMENT OF LSI>

LIQUID EJECTING APPARATUS, HEAD UNIT, AND METHOD OF CONTROLLING LIQUID EJECTING APPARATUS

The entire disclosure of Japanese Patent Application No. 2014-061521, filed Mar. 25, 2014 is expressly incorporated by reference herein.

BACKGROUND

1. Technical Field

The present invention relates to a liquid ejecting apparatus, a head unit, and a method of controlling the liquid ejecting apparatus.

2. Related Art

In ink jet printers that print images or documents by ejecting ink, piezoelectric elements (for example, piezo elements) are known to be used. The piezoelectric elements are installed to correspond to a plurality of nozzles in head units, respectively, and are driven according to driving signals so that a predetermined amount of ink (liquid) is ejected from the nozzles at predetermined timings and dots are formed. Since the piezoelectric elements are capacitive loads as in capacitors from the electric viewpoint, sufficient currents are necessarily supplied in order to operate the piezoelectric elements of the respective nozzles.

For this reason, driving signals amplified by amplification circuits are configured to be supplied to the head units so that the piezoelectric elements are driven. As the amplification circuits, types of circuits (linear amplification; see JP-A-2009-190287) performing current amplification on source signals before amplification into class AB or the like can be exemplified. However, since power consumption is large and energy efficiency is poor in the linear amplification, class D amplification has recently been proposed as well (see JP-A-2010-114711).

On the other hand, in printing apparatuses, high-speed printing or high-resolution printing have recently been requested strongly. In order to realize the high-speed printing, the number of dots formable per unit time may be increased. In order to realize the high-resolution printing, the amount of ink ejected from the nozzles may be set to be small and the number of dots formable per unit area may be increased. That is, in order to realize the high-speed printing and the high-resolution printing, the number of dots formable per unit time and unit area may be increased. In order to increase the number of dots, a method of increasing an ink ejection frequency is adopted.

Incidentally, in order to increase the ink ejection frequency, it is necessary to increase the frequency of a driving signal supplied to the piezoelectric elements. In order to increase the frequency of the driving signal, decrease an influence of residual vibration or the like, and perform reliable ejection, it is necessary to increase a switching frequency of class D amplification.

However, when the switching frequency is increased, a loss by switching becomes large. Eventually, energy efficiency in the class D amplification may be less than energy efficiency by linear amplification, and thus high energy efficiency which is the advantage of the class D amplification may not be realized.

Further, when the switching in the class D amplification is performed at a high frequency, a problem of an erroneous operation by noise, heat generation resulting from a switching loss, or the like occurs.

Thus, when the switching frequency of the class D amplification is increased in order to increase the frequency of the driving signal used to drive the piezoelectric elements, many problems may occur.

SUMMARY

An advantage of some aspects of the invention is that it provides a liquid ejecting apparatus, a head unit, and a method of controlling the liquid ejecting apparatus in which high-sped printing and high-resolution printing can be realized in a configuration in which piezoelectric elements are driven by a driving signal subjected to class D amplification.

According to an aspect of the invention, there is provided a liquid ejecting apparatus including: a modulation circuit that generates a modulated signal obtained by performing pulse modulation on a source signal; a transistor that amplifies the modulated signal to generate an amplified modulated signal; a lowpass filer that smoothes the amplified modulated signal to generate a driving signal; a piezoelectric element that is displaced when the driving signal is applied; a cavity of which an internal volume changes through the displacement of the piezoelectric element; a nozzle that is formed to eject a liquid in the cavity according to the change in the internal volume of the cavity; and a circuit substrate on which the modulation circuit, the transistor, and the lowpass filter are mounted. The transistor includes a die that forms the transistor, a first electrode that is formed on one surface of the die, second and third electrodes that are formed on the other surface of the die, a conductive die pad that is electrically adhered to the first electrode, a first lead which is electrically connected to the second electrode by a bonding wire, and a second lead which is electrically connected to the third electrode by a bonding wire. The die pad, the first lead, and the second lead are electrically connected to different wiring patterns of the circuit substrate.

In the liquid ejecting apparatus according to the aspect of the invention, since the inductance parasitized in the transistor is small, the influence of voltage noise such as overshoot is suppressed. Therefore, the frequency of the modulated signal (amplified modulated signal) which is a switching signal can be increased. Therefore, by increasing the frequency of the driving signal applied to the piezoelectric element, it is possible to realize high-speed printing and high-resolution printing. Heat generated in the die transfers to the circuit substrate via the die pad guiding the first electrode to the printed circuit substrate. Therefore, it is possible to improve heat dissipation efficiency of the transistor.

The source signal is a signal which is a source of the driving signal defining the displacement of the piezoelectric element, that is, a signal before modulation and a signal (including a defining signal irrespective of an analog signal or a digital signal) serving as a creation of the waveform of the driving signal. The modulated signal is a digital signal obtained by performing pulse modulation (for example, pulse width modulation or pulse density modulation) on the source signal.

The lowpass filter is typically configured by an inductor (coil) and a capacitor, but a resistor may be added or the lowpass filter may be configured by a resistor and a capacitor excluding an inductor.

Incidentally, in the liquid ejecting apparatus according to the aspect of the invention, the amplified modulated signal is smoothed to generate the driving signal, the piezoelectric element is displayed by applying the driving signal, and then a liquid is ejected from the nozzle. Here, when the liquid ejecting apparatus performs frequency spectrum analysis on the waveform of the driving signal to eject, for example, a small dot, a frequency component equal to or greater than 50 kHz can be known to be included. In order to generate the driving signal including such a frequency component equal to or greater than 50 kHz, it is necessary to set the frequency of the modulated signal (amplified modulated signal) to be equal to or greater than 1 MHz.

When the frequency of the modulated signal is set to be less than 1 MHz, the edge of the waveform of the reproduced driving signal may become dull and round. In other words, the angle becomes gentle and the waveform becomes dull. When the waveform of the driving signal becomes dull, the waveform rises and the displacement of the piezoelectric element operating according to the falling edge is slowed. Thus, tailing at the time of ejection, an ejection failure, or the like may occur, and thus printing quality may deteriorate.

On the other hand, when the frequency of the modulated signal is set to be greater than 8 MHz, the resolution of the waveform of the driving signal increases. However, since the switching frequency in the transistor increases, a switching loss becomes larger, and thus low power consumption and low heat generation which are superior properties compared to linear amplification of a class AB amplifier or the like may be impaired.

Therefore, in the liquid ejecting apparatus according to the aspect of the invention, the frequency of the modulated signal is preferably equal to or greater than 1 MHz and equal to or less than 8 MHz.

In the liquid ejecting apparatus according to the aspect of the invention, a through hole may be formed in a region in which the transistor is mounted in the circuit substrate. Thus, heat generated in the transistor can be escaped to the wiring patterns of the layers of other layers via the through hole.

In the liquid ejecting apparatus according to the aspect of the invention, the modulation circuit may feed back a signal which is based on one of the modulated signal, the amplified modulated signal, and the driving signal to generate the modulated signal. The driving signal obtained by reproducing the source signal more faithfully can be output by the feedback. As a delay component of the feedback driving signal is smaller, the frequency of the modulated signal can be increased.

Since the driving signal is a signal smoothed from the amplified modulated signal, the voltage amplitude is large. Therefore, for example, it is preferable to attenuate the driving signal and then obtain a deviation between the driving signal and the source signal rather than directly obtaining the deviation between the driving signal and the source signal. The signal which is based on the driving signal is meant to be used as an indirectly indicated signal rather than a directly indicated driving signal.

The modulated signal (amplified modulated signal) can be used as the feedback signal as well as the driving signal.

The invention can be realized according to various aspects. For example, the invention can be realized according to various aspects such as a method of controlling a liquid ejecting apparatus and a single head unit.

BRIEF DESCRIPTION OF THE DRAWINGS

The invention will be described with reference to the accompanying drawings, wherein like numbers reference like elements.

FIGS. 22A and 22B are sectional views illustrating of the structure of the transistor and the like.

FIG. 26 is an end view illustrating mounting of the capacitor and the like.

DESCRIPTION OF EXEMPLARY EMBODIMENTS

Hereinafter, modes for carrying out the invention will be described with reference to the drawings.

A printing apparatus according to an embodiment is an ink jet printer, that is, a liquid ejecting apparatus, that ejects ink according to image data supplied from an external host computer to form an ink dot group on a printing medium such as a sheet and accordingly prints an image (text, a figure, or the like) according to the image data.

Figure 1:
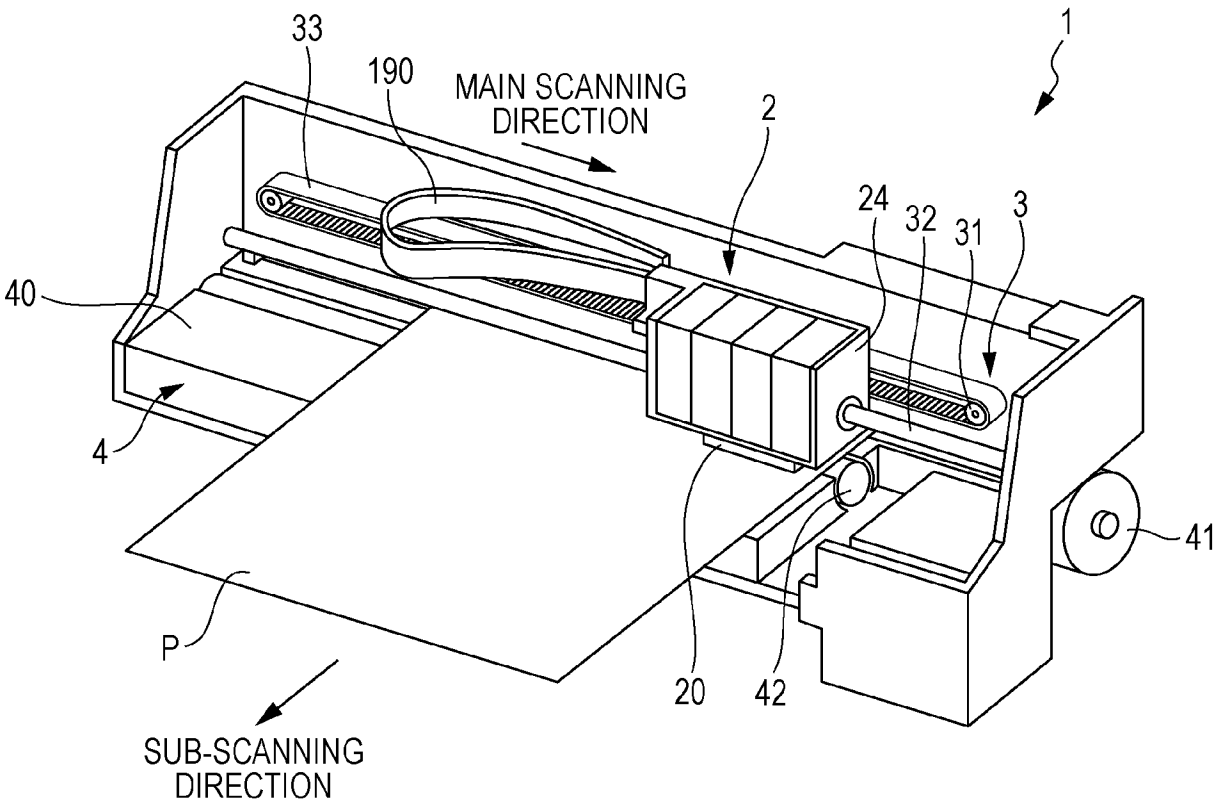
FIG. 1 is a diagram illustrating a schematic configuration of a printing apparatus.

FIG. 1 is a perspective view illustrating the schematic configuration of the inside of the printing apparatus.

As illustrated in the drawing, a printing apparatus 1 includes a movement mechanism 3 that moves (reciprocates) a moving body 2 in a main scanning direction.

The movement mechanism 3 includes a carriage motor 31 that serves as a driving source for the moving body 2, a carriage guide shaft 32 of which both ends are fixed, and a timing belt 33 that extends substantial in parallel to the carriage guide shaft 32 and is driven by the carriage motor 31.

A carriage 24 of the moving body 2 is supported by the carriage guide shaft 32 to reciprocate and is fixed to a part of the timing belt 33. Therefore, when the timing belt 33 is traveled forward and backward by the carriage motor 31, the moving body 2 is guided by the carriage guide shaft 32 to moves in a reciprocating manner.

A head unit 20 is installed in a portion of the moving body 2 facing a printing medium P. As will be described below, the head unit 20 is a unit that ejects ink droplets (liquid droplets) from a plurality of nozzles and is configured to be supplied with various control signals or the like via a flexible cable 190.

The printing apparatus 1 includes a transport mechanism 4 that transports the printing medium P in a sub-scanning direction on a platen 40. The transport mechanism includes a transport motor 41 that serves as a driving source and a transport roller 42 that is rotated by the transport motor 41 to transport the printing medium P in the sub-scanning direction.

The head unit 20 ejects the ink droplets to the printing medium P at a timing at which the printing medium P is transported by the transport mechanism 4, so that an image is formed on the surface of the printing medium P.

Figure 2:
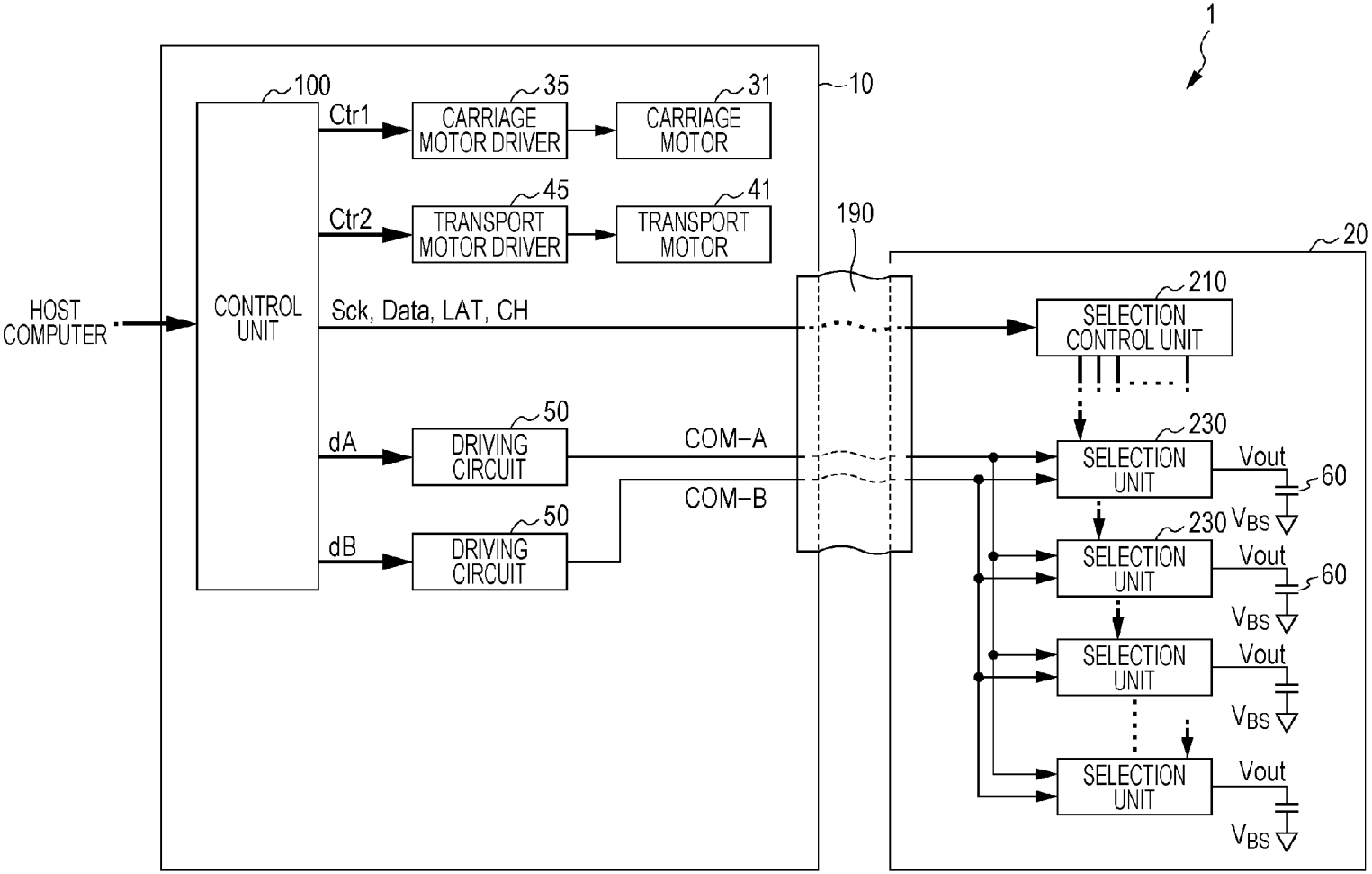
FIG. 2 is a block diagram illustrating the configuration of the printing apparatus.

FIG. 2 is a block diagram illustrating an electric configuration of the printing apparatus.

In the printing apparatus 1, as illustrated in the drawing, the control unit 10 and the head unit 20 are connected to each other through the flexible cable 190.

The control unit 10 includes a control unit 100, the carriage motor 31, a carriage motor driver 35, a transport motor 41, a transport motor driver 45, two driving circuits 50, and the head unit 20. Of the units, the control unit 100 outputs various control signals and the like to control each unit when image data is supplied from a host computer.

Specifically, first, the control unit 100 supplies a control signal Ctr1 to the carriage motor driver 35 so that the carriage motor driver 35 drives the carriage motor 31 according to the control signal Ctr1. Thus, the movement of the carriage 24 in the main scanning direction is controlled.

Second, the control unit 100 supplies a control signal Ctr2 to the transport motor driver 45 so that the transport motor driver 45 drives the transport motor 41 according to the control signal Ctr2. Thus, movement in the sub-scanning direction by the transport mechanism 4 is controlled.

Third, the control unit 100 supplies digital data dA to one of the two driving circuits 50 and supplies a digital data dB to the other driving circuit. Here, the data dA defines the waveform of a driving signal COM-A among the driving signals supplied to the head unit 20 and the data dB defines the waveform of a driving signal COM-B.

As will be described below in detail, one of the driving circuits 50 performs analog conversion on the data dA, and then supplies the driving signal COM-A subjected to class D amplification to the head unit 20. Likewise, the other driving circuit 50 performs analog conversion on the data dB, and then supplies the driving signal COM-B subjected to class D amplification to the head unit 20.

Fourth, the control unit 100 supplies a clock signal Sck, a data signal Data, and control signals LAT and CH to the head unit 20.

The head unit 20 includes a selection control unit 210 and a plurality of pairs of selection units 230 and piezoelectric elements (piezo elements) 60.

The selection control unit 210 instructs each of the selection units 230 to select any driving signal between the driving signals COM-A and COM-B (or select none of the driving signals), using a control signal or the like supplied from the control unit 100. Then, the selection unit 230 selects the driving signal COM-A or COM-B according to the instruction from the selection control unit 210 and supplies the selected driving signal as a driving signal to one end of the piezoelectric element 60. In the drawing, a voltage of the driving signal is denoted by Vout.

In this example, a voltage $V_{BS}$ is applied commonly to the other ends of the piezoelectric elements 60.

The piezoelectric elements 60 are installed to correspond to the plurality of nozzles in the head unit 20, respectively. The piezoelectric element 60 is displaced according to a difference between a voltage Vout and the voltage $V_{BS}$ of the driving signal selected by the selection unit 230 to eject the ink. Accordingly, next, a configuration for ejecting the ink through driving in the piezoelectric elements 60 will be described in brief.

Figure 3:
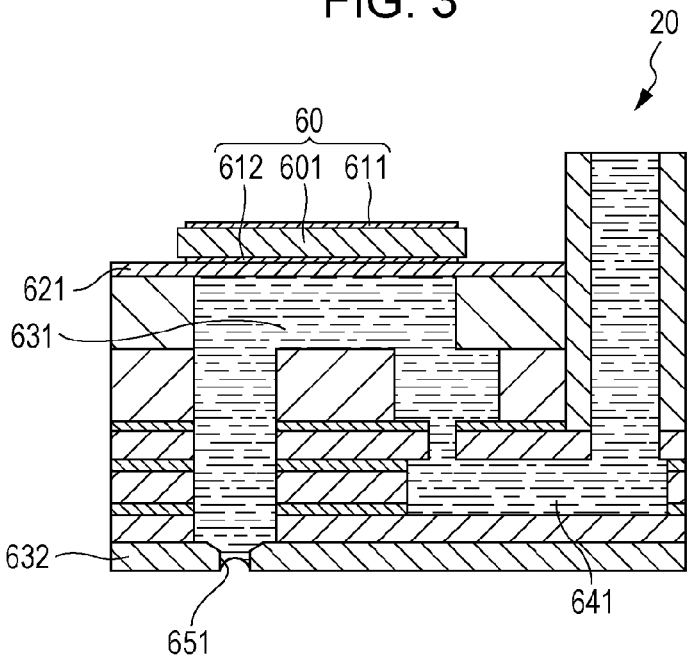
FIG. 3 is a diagram illustrating the configuration of an ejection unit in a head unit.

FIG. 3 is a diagram illustrating a schematic configuration corresponding to one nozzle in the head unit 20.

As illustrated in the drawing, the head unit 20 includes the piezoelectric element 60, a vibration plate 621, a cavity (pressure chamber) 631, a reservoir 641, and a nozzle 651. Of the constituents, the vibration plate 621 functions as a diaphragm that expands and contracts the internal volume of the cavity 631 filled with ink by being displaced (bending vibration) by the piezoelectric element 60 installed on an upper surface in the drawing. The nozzle 651 is installed in a nozzle plate 632 and is an opening portion communicating with the cavity 631.

The piezoelectric element 60 illustrated in the drawing has a structure in which a piezoelectric substance 601 is interposed between a pair of electrodes 611 and 612. A middle portion of the piezoelectric substance 601 in the structure in the drawing is bent vertically with respect to both end portions along with the electrodes 611 and 612 and the vibration plate 621 according to a voltage applied by the electrodes 611 and 612. Specifically, the piezoelectric element 60 is configured to be bent upward when the voltage Vout of the driving signal increases whereas being bent downward when the voltage Vout decreases. When the piezoelectric element 60 is bent upward in this configuration, the internal volume of the cavity 631 expands, and thus the ink is drawn into from the reservoir 641. Conversely, when the piezoelectric element 60 is bent downward, the internal volume of the cavity 631 contracts, and thus the ink is ejected from the nozzle 651 according to the degree of contraction.

The piezoelectric element 60 is not limited to the illustrated structure, but may be a type of piezoelectric element 60 that can eject a liquid such as ink by being deformed. The piezoelectric element 60 is not limited to the bending vibration, but may be configured using vertical vibration.

The piezoelectric element 60 is installed to correspond to the cavity 631 and the nozzle 651 in the head unit 20 and the piezoelectric element 60 is installed to also correspond to the selection unit 230 in FIG. 1. Therefore, a set of the piezoelectric element 60, the cavity 631, the nozzle 651, and the selection 230 is installed for each nozzle 651.

Figure 4A:
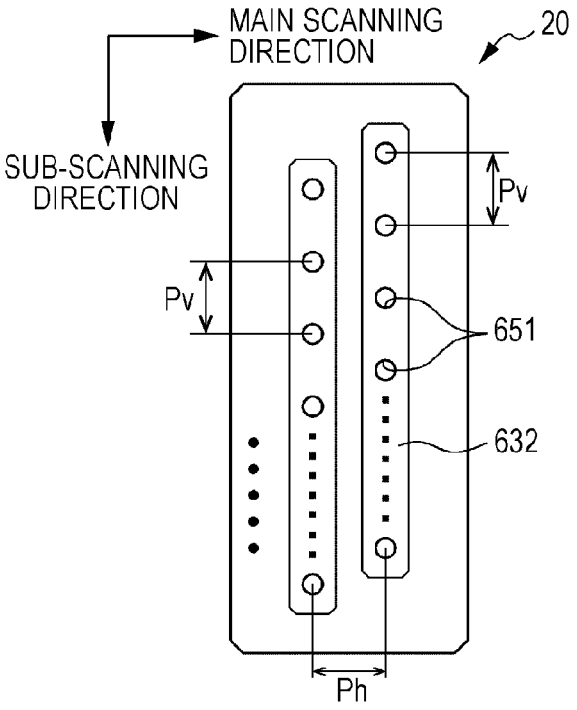
FIGS. 4A and 4B are diagrams illustrating the arrangement of nozzles in the head unit.

FIG. 4A is a diagram illustrating an example of the arrangement of the nozzles 651.

As illustrated in the drawing, the nozzles 651 are arranged in, for example, two rows. Specifically, in view of one row, the plurality of nozzles 651 are disposed at a pitch Pv in the sub-scanning direction. On the other hand, the two rows have a relation in which the rows are separated by a pitch Ph in the main scanning direction and are shifted by half of the pitch Pv in the sub-scanning direction.

When color printing is performed, a pattern of the nozzles 651 corresponding to colors such as cyan (C), magenta (M), yellow (Y), and black (K) are installed, for example, in the main scanning direction. However, to facilitate the following description, a case in which gray scales are expressed in monochrome will be described.

Figure 4B:
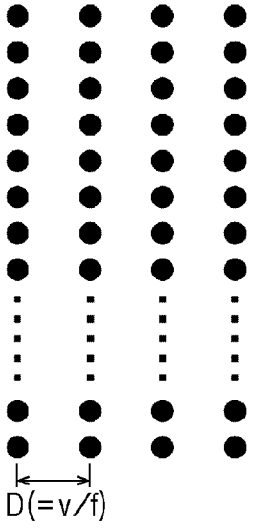

FIG. 4B is a diagram for describing a basic resolution for image forming in the arrangement of the nozzles illustrated in FIG. 4A. To facilitate the description, the drawing illustrates black-painted circles as dots formed by landing ink droplets in an example of a method (first method) of forming one dot by ejecting the ink droplet once from each nozzle 651.

When the head unit 20 moves in the main scanning direction at a speed v, as illustrated in the drawing, the speed v and an interval D of the dots (in the main scanning direction) formed by landing the ink droplets have the following relation.

That is, when one dot is formed by ejecting the one-time ink droplet once, the dot interval D is indicated by a value (=v/f) obtained by dividing the speed v by an ink ejection frequency f, in other words, a distance by which the head unit 20 moves at a period (1/f) at which the ink droplet is repeatedly ejected.

In the examples of FIGS. 4A and 4B, the pitch Ph has a relation proportional to the dot interval D with a coefficient n and the ink droplets ejected from the nozzles 651 in the two rows are landed to be arranged in the same rows on the printing medium P. Therefore, as illustrated in FIG. 4B, the dot interval in the sub-scanning direction is the half of the dot interval in the main scanning direction. The arrangement of the dots is, of course, not limited to the illustrated example.

Incidentally, in order to realize high-speed printing, the speed v at which the head unit 20 moves in the main scanning direction may be increased simply. However, when on the speed v is increased, the dot interval D becomes longer. Therefore, while a certain degree of resolution is ensured, it is necessary to increase the number of dots formed per unit time by increasing the ink ejection frequency f in order to realize the high-speed printing.

In order to increase a resolution apart from a printing speed, the number of dots formed per unit area may be increased. However, when the number of dots is increased, not only may mutually adjacent dots be joined if the amount of ink is not small, but also the printing speed may be lowered if the ink ejection frequency f is not high.

Thus, in order to realize high-speed printing and high-resolution printing, it is necessary to increase the ink ejection frequency f, as described above.

On the other hand, the method of forming dots on the printing medium P includes not only the method of forming one dot by ejecting an ink droplet once but also a method (second method) of forming one dot by landing one or more ink droplets ejected per unit time and joining the one or more landed ink droplets or a method (third method) of forming two or more dots without joining the two or more ink droplets, as a method of capable of ejecting ink droplets two or more times per unit time. In the following description, a case in which dots are formed according to the second method will be described.

In the embodiment, the second method will be made assuming the following example. That is, in the embodiment, four gray scales of a large dot, a middle dot, a small dot, and non-recording are expressed for one dot by ejecting ink up to twice. In order to express the four gray scales, in the embodiment, two kinds of driving signals COM-A and COM-B are prepared, and one period has a first-half pattern and a second-half pattern for each signal. The driving signal COM-A or COM-B is configured to be selected (or not selected) in the first half and the second half of one period according to a gray scale to be expressed and to be supplied to the piezoelectric element 60.

Accordingly, the driving signals COM-A and COM-B will be described, and then a configuration for selecting the driving signal COM-A or COM-B will be described. The driving signals COM-A and COM-B are generated by the respective driving circuits 50. The driving circuits 50 will be described after the configuration for selecting the driving signal COM-A or COM-B for convenience.

Figure 5:
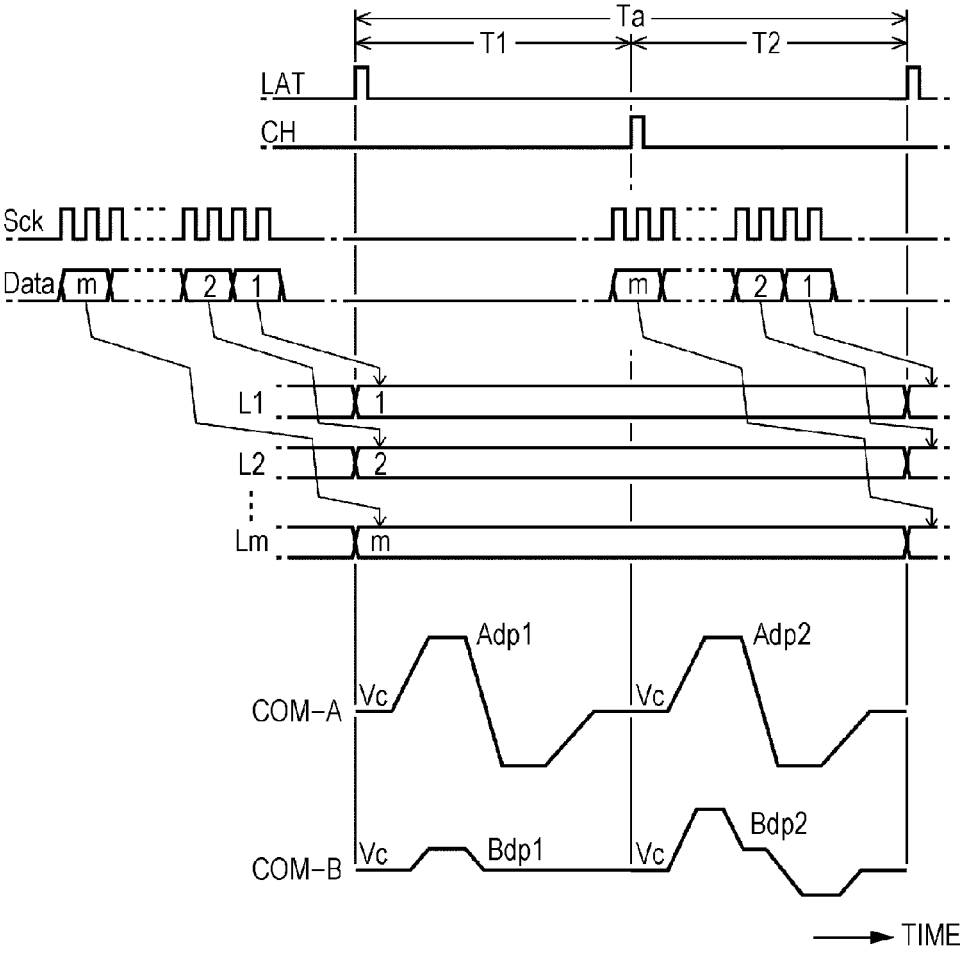
FIG. 5 is a diagram for describing an operation of a selection control unit in the head unit.

FIG. 5 is a diagram illustrating the waveforms of the driving signals COM-A and COM-B and the like.

As illustrated in the drawing, the driving signal COM-A has a continuous waveform of a trapezoid waveform Adp1 disposed in a period T1 in which the control signal LAT is output (rises) and the control signal CH is output in a printing period Ta and a trapezoid waveform Adp2 disposed in a period T2 in which the control signal CH is output and the subsequent control signal LAT is output in the printing period Ta.

In the embodiment, the trapezoid waveforms Adp1 and Adp2 are substantially the same waveform and are waveforms for ejecting a predetermined amount of ink, specifically, a middle amount of ink from the nozzle 651 corresponding to the piezoelectric element 60 when the trapezoid waveforms Adp1 and Adp2 are each supplied to one end of this piezoelectric element 60.

The driving signal COM-B has continuous waveforms of a trapezoid waveform Bdp1 disposed in the period T1 and a trapezoid waveform Bdp2 disposed in the period T2. In the embodiment, the trapezoid waveforms Bdp1 and Bdp2 are different waveforms. Of the trapezoid waveforms, the trapezoid waveform Bdp1 is a waveform for preventing the viscosity of the ink from increasing by minutely vibrating the ink near the opening portion of the nozzle 651. Therefore, even when the trapezoid waveform Bdp1 is supplied to one end of the piezoelectric element 60, no ink droplet is ejected from the nozzle 651 corresponding to this piezoelectric element 60. The trapezoid waveform Bdp2 is a waveform different from the trapezoid waveform Adp1 (Adp2). The trapezoid waveform Bdp2 is a waveform for ejecting the amount of ink less than the predetermined amount from the nozzle 651 corresponding to the piezoelectric elements 60 even when the trapezoid waveform Bdp2 is supplied to one end of this piezoelectric element 60.

All of the voltages at start timings and end timings of the trapezoid waveforms Adp1, Adp2, Bdp1, and Bdp2 are commonly a voltage Vc. That is, the trapezoid waveforms Adp1, Adp2, Bdp1, and Bdp2 are waveforms starting at the voltage Vc and ending at the voltage Vc.

Figures 6, 7:
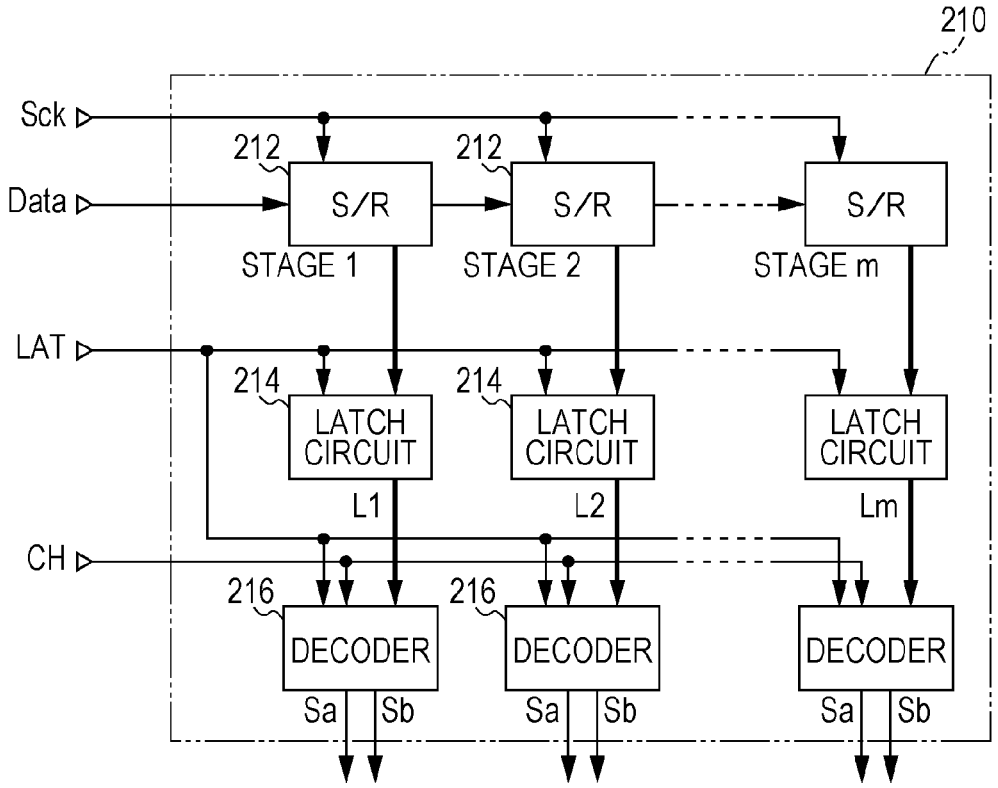
FIG. 6 is a diagram illustrating the configuration of the selection control unit in the head unit.
FIG. 7 is a diagram illustrating decoding contents of a decoder in the head unit.

FIG. 6 is a diagram illustrating the configuration of the selection control unit 210 in FIG. 2.

As illustrated in the drawing, the control unit 10 supplies the selection control unit 210 with the clock signal Sck, the data signal Data, and the control signals LAT and CH. In the selection control unit 210, a set of a shift register (S/R) 212, a latch circuit 214, and a decoder 216 are installed to correspond to each piezoelectric element 60 (nozzle 651).

The data signal Data defines the size of one dot when the dot of an image is formed. In the embodiment, the data signal Data has 2 bits of the most significant bit (MSB) and the least significant bit (LSB) in order to express four gray scales of non-recording, a small dot, a middle dot, and a large dot.

The data signal Data is supplied serially from the control unit 100 in tune with main scanning of the head unit 20 for each nozzle in synchronization with the clock signal Sck. The shift register 212 has a configuration in which the serially supplied data signal Data is temporarily retained by 2 bits to correspond to nozzle.

Specifically, the shift registers 212 of the number of stages corresponding to the piezoelectric element 60 (the nozzles) are cascade-connected to each other and the serially supplied data signals Data are configured to be transmitted sequentially to the rear stage according to the clock signal Sck.

When m (m is plural) is the number of piezoelectric elements 60, stage 1, stage 2, . . . , and stage m are notated sequentially from the upper stream side from which the data signal Data is supplied in order to distinguish the shift registers 212 from each other.

The latch circuit 214 latches the data signal Data retained in the shift register 212 at the rise of the control signal LAT.

The decoder 216 decodes the 2-bit data signal Data latched by the latch circuit 214, outputs selection signals Sa and Sb for each period T1 and each period T2 defined by the control signal LAT and the control signal CH, and defines the selection in the selection unit 230.

FIG. 7 is a diagram illustrating decoding contents in the decoder 216.

In the drawing, (MSB, LSB) are notated for the latched 2-bit printing data Data. For example, when the latched printing data Data is (0, 1), this printing data Data means that the decoder 216 sets logic levels of the selection signals Sa and Sb to H and L levels, respectively in the period T1 and sets the logic levels of the selection signals Sa and Sb to L and H levels, respectively, in the period T2.

The logic levels of the selection signals Sa and Sb are subjected to level shift to be set to higher amplitude levels by a level shifter (not illustrated) than the logic levels of the clock signal Sck, the printing data Data, and the control signals LAT and CH.

Figure 8:
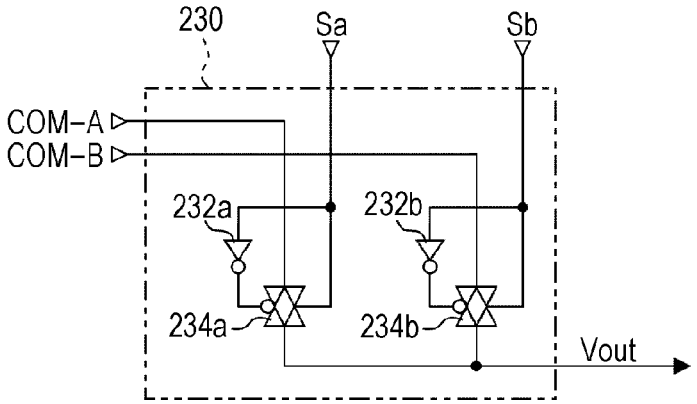
FIG. 8 is a diagram illustrating the configuration of a selection unit in the head unit.

FIG. 8 is a diagram illustrating the selection unit 230 corresponding to one piezoelectric element 60 (nozzle 651) in FIG. 2.

As illustrated in the drawing, the selection unit 230 includes inverters (NOT circuits) 232*a* and 232*b* and transfer gates 234*a* and 234*b*.

The selection signal Sa from the decoder 216 is supplied to a positive control end with no circle mark in the transfer gate 234*a*. On the other hand, the selection signal Sa is subjected to logic inversion by the inverter 232*a* and is supplied to a negative control end with a circle mark in the transfer gate 234*a*. Likewise, the selection signal Sb is supplied to a positive control end of the transfer gate 234*b*. On the other hand, the selection signal Sb is subjected to logic conversion by the inverter 232*b* and is supplied to a negative control end of the transfer gate 234*b*.

The driving signal COM-A is supplied to an input end of the transfer gate 234*a* and the driving signal COM-B is supplied to an input end of the transfer gate 234*b*. Output ends of the transfer gates 234*a* and 234*b* are commonly connected and are connected to one end of the corresponding piezoelectric element 60.

When the selection signal Sa is in the H level, the transfer gate 234*a* electrifies (turns on) the input end and the output end. When the selection signal Sa is in the L level, the transfer gate 234*a* not electrify (turns off) the input end and the output end. Likewise, the transfer gate 234*b* turns on and off the input end and the output end according to the selection signal Sb.

Next, an operations of the selection control unit 210 and the selection unit 230 will be described with reference to FIG. 5.

The data signal Data is supplied serially from the control unit 100 for each nozzle in synchronization with the clock signal Sck and is transmitted sequentially to the shift registers 212 corresponding to the nozzles. When the control unit 100 stops supplying the clock signal Sck, each of the shift registers 212 enters a state in which the data signal Data corresponding to the nozzle is retained. The data signal Data is supplied in order corresponding to the nozzles of the final stage m, . . . , stage 2, and stage 1 of the shift registers 212.

Here, when the control signal LAT rises, the latch circuits 214 simultaneously latch the data signal Data retained in the shift registers 212. In FIG. 5, L1, L2, . . . , and Lm indicate the data signals Data latched by the latch circuits 214 corresponding to the shift registers 212 at stage 1, stage 2, . . . , and stage m.

The decoder 216 outputs the logic levels of the selection signals Sa and Sb, as shown in the contents illustrated in FIG. 7, in the periods T1 and T2 according to the sizes of the dots defined by the latched data signals Data.

That is, first, when the data signal Data is (1, 1) and defines the size of a large dot, the decoder 216 sets the selection signals Sa and Sb to the H and L levels, respectively, in the period T1 and also sets the selection signals Sa and Sb to the H and L levels, respectively, in the period T2. Second, when the data signal Data is (0, 1) and defines the size of a middle dot, the decoder 216 sets the selection signals Sa and Sb to the H and L levels, respectively, in the period T1 and also sets the selection signals Sa and Sb to the L and H levels, respectively, in the period T2. Third, when the data signal Data is (1, 0) and defines the size of a small dot, the decoder 216 sets the selection signals Sa and Sb to the L and L levels, respectively, in the period T1 and also sets the selection signals Sa and Sb to the L and H levels, respectively, in the period T2. Fourth, when the data signal Data is (0, 0) and defines non-recording, the decoder 216 sets the selection signals Sa and Sb to the L and H levels, respectively, in the period T1 and also sets the selection signals Sa and Sb to the L and L levels, respectively, in the period T2.

Figure 9:
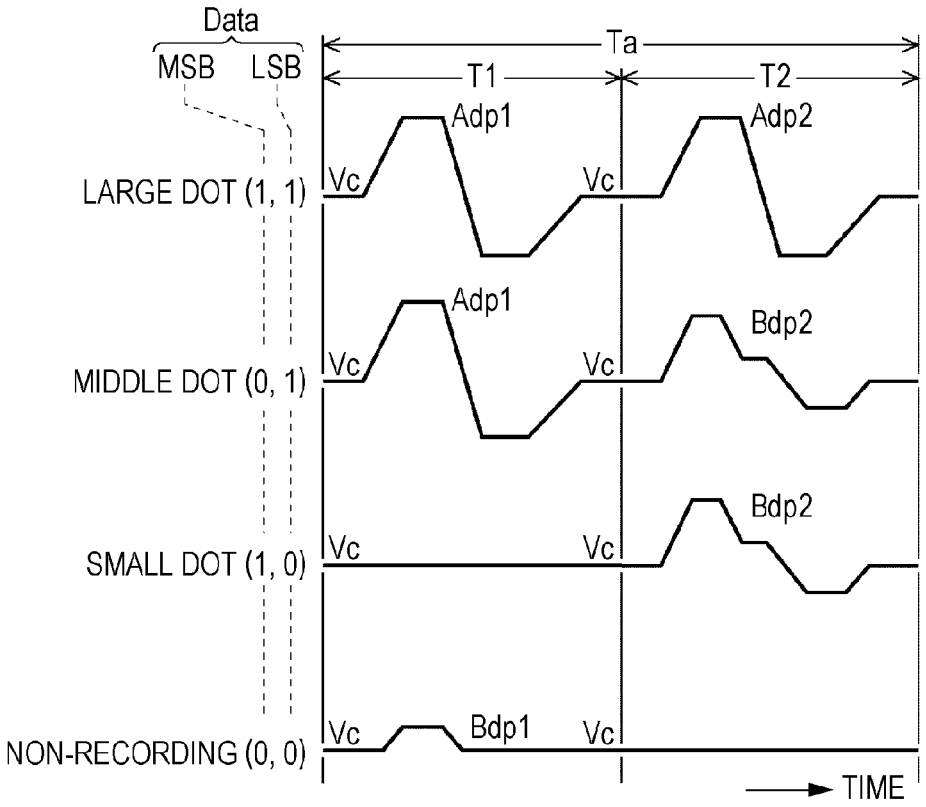
FIG. 9 is a diagram illustrating a driving signal selected by the selection unit.

FIG. 9 is a diagram illustrating voltage waveforms of the driving signal selected according to the data signal Data and supplied to one end of the piezoelectric element 60.

When the data signal Data is (1, 1), the selection signals Sa and Sb are in the H and L levels in the period T1, respectively. Therefore, the transfer gate 234*a* is turned on and the transfer gate 234*b* is turned off. Therefore, the trapezoid waveform Adp1 of the driving signal COM-A is selected in the period T1. Since the selection signals Sa and Sb are in the H and L levels even in the period T2, the selection unit 230 selects the trapezoid waveform Adp2 of the driving signal COM-A.

Thus, when the trapezoid waveform Adp1 is selected in the period T1, the trapezoid waveform Adp2 is selected in the period T2, and the selected trapezoid waveform is supplied as the driving signal to one end of the piezoelectric element 60, the middle amount of ink is ejected separately twice from the nozzle 651 corresponding to this piezoelectric element 60. Therefore, the respective ink is landed to be integrated on the printing medium P and the large dot defined by the data signal Data is consequently formed.

When the data signal Data is (0, 1), the selection signals Sa and Sb are in the H and L levels in the period T1, respectively. Therefore, the transfer gate 234*a* is turned on and the transfer gate 234*b* is turned off. Therefore, the trapezoid waveform Adp1 of the driving signal COM-A is selected in the period T1. Since the selection signals Sa and Sb are in the L and H levels in the period T2, the trapezoid waveform Bdp2 of the driving signal COM-B is selected.

Accordingly, the middle amount of link and the small amount of ink are ejected separately twice from the nozzle. Therefore, the respective ink is landed to be integrated on the printing medium P and the middle dot defined by the data signal Data is consequently formed.

When the data signal Data is (1, 0), the selection signals Sa and Sb are in the L level together in the period T1. Therefore, the transfer gate 234*a* and the transfer gate 234*b* are turned off. Therefore, none of the trapezoid waveforms Adp1 and Bdp1 is selected in the period T1. When the transfer gates 234*a* and 234*b* are turned off together, a route from a connection point of the output ends of the transfer gates 234*a* and 234*b* to one end of the piezoelectric element 60 enters a high-impedance state in which there is no electric connection. However, the piezoelectric element retains a voltage ($Vc-V_{BS}$) immediately before the transfer gates are turned off, because of a capacitive property of the piezoelectric element 60.

Next, since the selection signals Sa and Sb are in the L and H level in the period T2, the trapezoid waveform Bdp2 of the driving signal COM-B is selected. Therefore, since the small amount of ink is ejected from the nozzle 651 only in the period T2, the small dot defined by the data signal Data is formed on the printing medium P.

When the data signal Data is (0, 0), the selection signals Sa and Sb are in the L and H levels in the period T1, the transfer gate 234*a* is turned off and the transfer gate 234*b* is turned on. Therefore, the trapezoid waveform Bdp1 of the driving signal COM-B is selected in the period T1. Next, since the selection signals Sa and Sb are in the L level together in the period T2, none of the trapezoid waveforms Adp2 and Bdp2 is selected.

Therefore, since the ink near the opening portion of the nozzle 651 merely vibrates minutely in the period T1 and no ink is ejected, no dot is consequently formed, that is, non-recording defined by the data signal Data is performed.

In this way, the selection unit 230 selects the driving signal COM-A or COM-B (or selects none thereof) according to an instruction from the selection control unit 210 and supplies the selected driving signal to one end of the piezoelectric element 60. Therefore, each piezoelectric element 60 is driven according to the size of the dot defined by the data signal Data.

The driving signals COM-A and COM-B illustrated in FIG. 5 are merely examples. In practice, combinations of various waveforms prepared in advance are used according to a movement speed of the head unit 20, the nature of the printing medium P, and the like.

Here, the example in which the piezoelectric element 60 is bent upward with an increase in a voltage has been described. However, when the voltage supplied to the electrodes 611 and 612 is inverted, the piezoelectric element 60 is bent downward with an increase in a voltage. Therefore, in a configuration in which the piezoelectric element 60 is bent downward with an increase in a voltage, the driving signals COM-A and COM-B exemplified in the drawing are waveforms inverted using the voltage Vc as a criterion.

Thus, in the embodiment, one dot is formed on the printing medium P by using the period Ta, which is a unit period, as a unit. Therefore, in the embodiment in which one dot is formed by ejecting the ink droplets twice (maximally) in the period Ta, the ink ejection frequency f is 2/Ta and the dot interval D is a value obtained by dividing the movement speed v of the head unit by the ink ejection frequency f (=2/Ta).

In general, when ink droplets can be ejected Q times (where Q is an integer equal to or greater than 2) in a unit period T and one dot is formed by ejecting the ink droplets Q times, the ink ejection frequency f can be expressed as Q/T.

As in the embodiment, a time (period) necessary to form one dot is the same, but it is necessary to shorten a time in which one ink droplet is ejected once when dots with different sizes are formed on the printing medium P, compared to a case in which one dot is formed by ejecting a one-time ink droplet once.

It is not necessary to particularly describe the third method of forming two or more dots without joining the two or more ink droplets.

Next, the driving circuits 50 will be described. To sum up, the two driving circuits 50 generate the driving signal COM-A (COM-B) as follows. That is, of the two driving circuits 50, one driving circuit first performs analog conversion on the data dA supplied from the control unit 100. Second, the driving circuit feeds back the driving signal COM-A to be output, corrects a deviation between a signal (attenuated signal) which is based on the driving signal COM-A and a target signal using a high-frequency component of the driving signal COM-A, and generates a modulated signal according to the corrected signal. The driving circuit third generates an amplified modulated signal by switching a transistor according to the modulated signal, fourth smoothes the amplified modulated signal using a lowpass filter, and outputs the smoothed signal as the driving signal COM-A.

Of the two driving circuits 50, the other driving circuit also has the same configuration and differs merely in that the driving signal COM-B is output from the data dB. Accordingly, the driving circuit 50 outputting the driving circuit COM-A will be described as an example for convenience.

Figure 10:
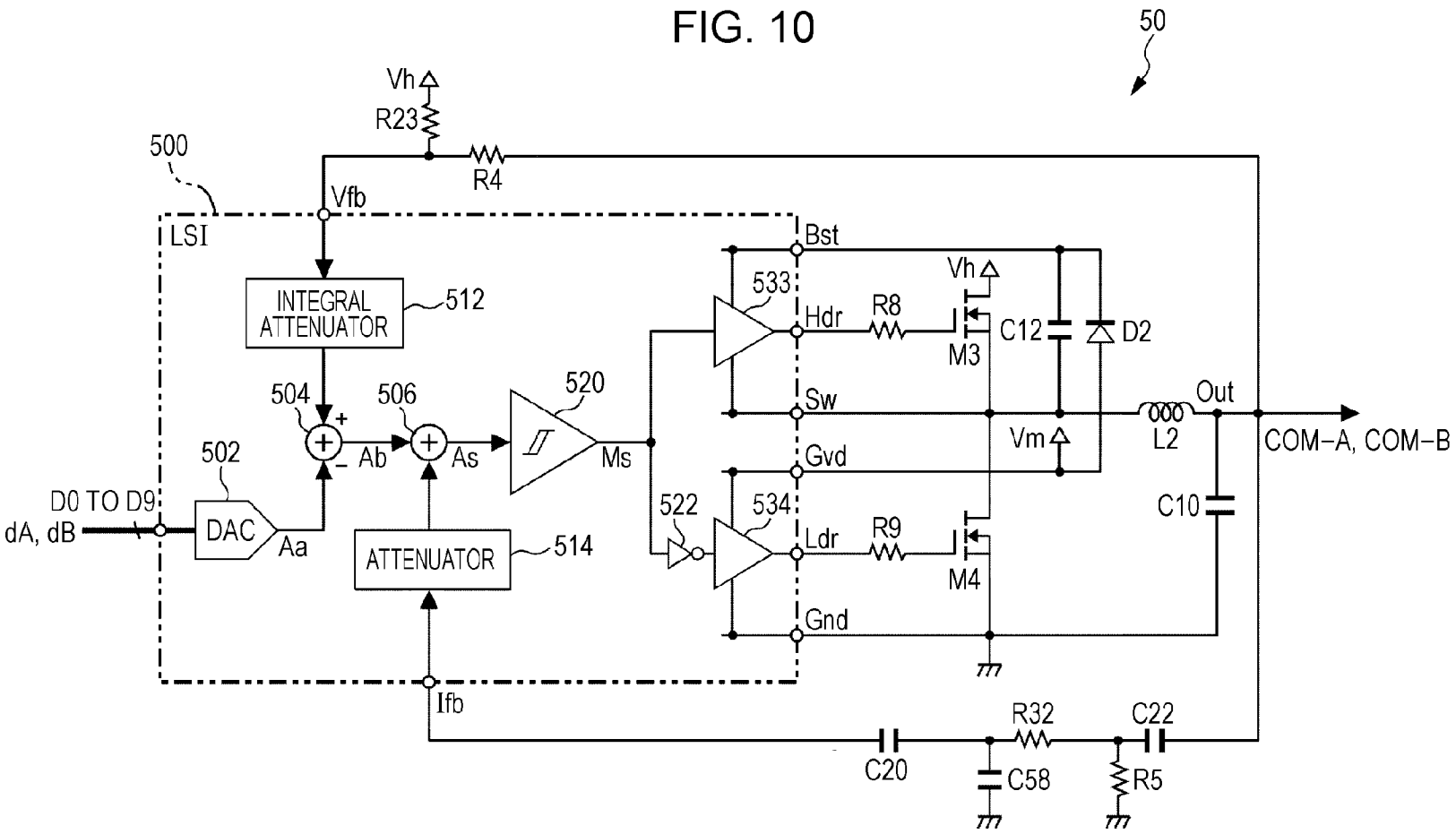
FIG. 10 is a diagram illustrating the configuration of a driving circuit in the printing apparatus.

FIG. 10 is a diagram illustrating a circuit configuration of the driving circuit 50.

As illustrated in the drawing, the driving circuit is configured to include various elements such as resistors and capacitors in addition to an LSI 500, transistors M3 and M4.

FIG. 10 illustrates a configuration for outputting the driving signal COM-A. In the LSI 500, however, circuits configured to generate both of the driving signals COM-A and COM-B of two systems are packaged to one circuit in practice.

The large scale integration (LSI) 500 outputs a gate signal of each of the transistors M3 and M4 based on the 10-bit data dA input from the control unit 100 via pins D0 to D9. Therefore, the LSI 500 includes a digital-to-analog converter (DAC) 502, adders 504 and 506, an integral attenuator 512, an attenuator 514, a comparator 520, a NOT circuit 522, and gate drivers 533 and 534.

The DAC 502 converts the data dA defining the waveform of the driving signal COM-A into an analog signal Aa and supplies the analog signal Aa to an input end (−) of the adder 504. A voltage amplitude of the analog signal Aa is in the range of, for example, about 0 volts to about 2 volts and a signal obtained by amplifying this voltage about 20 times is the driving signal COM-A. That is, the analog signal Aa is a target signal before the amplification of the driving signal COM-A.

The integral attenuator 512 attenuates and integrates a voltage of a terminal Out input via a pin Vfb, that is, the driving signal COM-A, and then supplies the driving signal COM-A to an input end (+) of the adder 504.

The adder 504 supplies one of input ends of the adder 506 with a signal Ab of a voltage obtained by subtracting the voltage of the input end (−) from the voltage of the input end (+) and performing integration.

A power source voltage of circuits from the DAC 502 to the NOT circuit 522 is 3.3 volts (voltage Vdd) with a low amplitude. Therefore, since the maximum voltage of the analog signal Aa is about 2 bolts and the maximum voltage of the driving signal COM-A is greater than 40 volts, the voltage of the driving signal COM-A is attenuated by the integral attenuator 512 in order to match amplitude ranges of both voltages when the deviation is obtained.

The attenuator 514 attenuates the high-frequency component of the driving signal COM-A input via a pin Ifb and supplies the attenuated driving signal COM-A to the other input end of the adder 506. The adder 506 supplies the comparator 520 with a signal As having the voltage obtained by adding the voltage at the one input end and the voltage at the other input end. The attenuation by the attenuator 514 is performed to match the amplitudes when the driving signal COM-A is feedback as in the integral attenuator 512.

The voltage of the signal As output from the adder 506 is a voltage obtained by subtracting the voltage of the analog signal Aa from the attenuated voltage of the signal supplied to the pin Vfb and adding the attenuated voltage of the signal supplied to the pin Ifb. Therefore, the voltage of the signal Ab by the adder 506 can be said to be a signal obtained by correcting a deviation between the attenuated voltage of the driving signal COM-A output from the terminal Out and the voltage of the analog signal Aa which is a target using the high-frequency component of the driving signal COM-A.

The comparator 520 outputs a modulated signal Ms subjected to pulse modulation as follows based on an added voltage by the adder 506. Specifically, the comparator 520 outputs the modulated signal Ms which becomes the H level when the signal As output from the adder 506 is equal to or greater than a voltage threshold value Vth1 at the time of an increase in the voltage and which becomes the L level when the signal As is less than the voltage threshold value Vth2 at the time of a decrease in the voltage. As will be described below, the voltage threshold value is set to have the following relation:

$$Vth1 > Vth2.$$

The modulated signal Ms by the comparator 520 is supplied to the gate driver 534 through logic inversion performed by the NOT circuit 522. On the other hand, the modulated signal Ms is supplied to the gate driver 533 without the logic inversion. Therefore, the logic levels supplied to the gate drivers 533 and 534 have a mutually exclusive relation.

The logic levels supplied to the gate drivers 533 and 534 may be actually subjected to timing control so that the logic levels do not become the H level simultaneously (so that the transistors M3 and M4 are not turned on simultaneously). Therefore, the term "exclusive" has, strictly speaking, a meaning that the logic levels do not become the H levels simultaneously (the transistors M3 and M4 are not turned on simultaneously in terms of the transistors M3 and M4).

Incidentally, the term "the modulated signal" mentioned here is the modulated signal Ms in a narrow sense. However, when the modulated signal is subjected to pulse modulation according to the signal Aa, a negation signal (the NOT circuit 522) of the modulated signal Ms is also included in the modulated signal. That is, the modulated signal subjected to the pulse modulation according to the signal Aa includes not only the modulated signal Ms but also a signal obtained by inverting the logic level of the modulated signal Ms or a signal subjected to timing control.

Since the comparator 520 outputs the modulated signal Ms, circuits up to the comparator 520, that is, the DAC 502, the adders 504 and 506, the integral attenuator 512, the attenuator 514, and the comparator 520, can be said to be a modulation circuit generating the modulated signal Ms.

In the configuration illustrated in FIG. 10, the digital data dA is converted into the analog signal Aa by the DAC 502. However, the signal Aa may be supplied from an external circuit, for example, according to an instruction from the control unit 100 without passing through the DAC 502. Even when either the digital data dA or the analog signal Aa is set, a target value corresponding to the generation of the waveform of the driving signal COM-A is defined. Therefore, there is no change for the source signal.

The gate driver 534 performs level shift to shaft a low logic amplitude (L level: 0 volts and H level: 3.3 volts) which is an output signal of the comparator 520 to a high logic amplitude (for example, L level: 0 volts and H level: 7.5 volts) and outputs the shifted logic amplitude from a pin Ldr. Of power supply voltages of the gate driver 534, a voltage Vm (for example, 12 volts) is applied as a high side via a pin Gvd and a zero voltage is applied as a low side via a pin Gnd, that is, the pin Gvd is grounded to the ground. The pin Gvd is connected to a cathode electrode of a diode D2 for backflow prevention and an anode electrode of the diode D2 is connected to one end of a capacitor C12 and a pin Bst.

The gate driver 533 performs level shift to shift the low logic amplitude which is the output signal of the NOT circuit 522 to a high logic amplitude and outputs the shifted logic amplitude from a pin Hdr. Of power supply voltages of the gate driver 533, a high side is a voltage applied via the pin Bst and a low side is a voltage applied via a pin Sw. The pin Sw is connected to a source electrode of the transistor M3, a drain electrode of the transistor M4, the other end of the capacitor C12, and an one end of an inductor L2.

The transistors M3 and M4 are, for example, N-channel field effect transistors (FETs). Of these transistors, in the transistor M3 of the high side, a voltage Vh (for example, 42 volts) is applied to a drain electrode and a gate electrode is connected to the pin Hdr via a resistor R8. In other words, when the resistor R8 is used as a criterion, one end of the resistor R8 is connected to the pin Hdr and the other end of the resistor R8 is connected to the gate electrode of the transistor M3. In the transistor M4 of the low side, a gate electrode is connected to the pin Ldr via a resistor R9 and a source electrode is grounded to the ground. In other words, when the resistor R9 is used as a criterion, one end of the resistor R9 is connected to the pin Ldr and the other end of the resistor R9 is connected to a gate electrode of the transistor M4.

The other end of the inductor L2 is a terminal Out which is an output in the driving circuit 50. The driving signal COM-A is supplied from the terminal Out to the head unit 20 via the flexible cable 190 (see FIGS. 1 and 2).

The terminal Out is connected to one end of a capacitor C10, one end of a capacitor C22, and a one end of a resistor R4. Of the capacitor C10, the capacitor C22, and the resistor R4, the other end of the capacitor C10 is grounded to the ground. Therefore, the inductor L and the capacitor C10 function as a lowpass filter (LPF) that smoothes the amplified modulated signal appearing at a connection point of the transistors M3 and M4.

The other end of the resistor R4 is connected to one end of the resistor R23 and the pin Vfb and the voltage Vh is applied to the other end of the resistor R23. Thus, the driving signal COM-A from the terminal Out is pulled up to the pin Vfb to be feedback.

On the other hand, the other end of the capacitor C22 is connected to one end of the resistor R5 and one end of a resistor R32. Of the resistor R5 and the resistor R32, the other end of the resistor R5 is grounded to the ground. Therefore, the capacitor C22 and the resistor R5 function as a highpass filter (HPF) that passes a high-frequency component equal to or greater than a cutoff frequency in the driving signal COM-A from the terminal Out. The cutoff frequency of the HPF is set to, for example, about 9 MHz.

The other end of the resistor R32 is connected to one end of a capacitor C20 and one end of a capacitor C58. Of the capacitor C20 and the capacitor C58, the other end of the capacitor C58 is grounded to the ground. Therefore, the resistor R32 and the capacitor C58 function as a lowpass filter (LPF) that passes a low-frequency component equal to or less than a cutoff frequency in the signal components passing through the HPF. The cutoff frequency of the LPF is set to, for example, about 160 MHz.

Since the cutoff frequency of the HPF is set to be lower than the cutoff frequency of the LPF, the HPF and the LPF function as a band-pass filter (BPF) that passes a high-frequency component of a predetermined frequency region in the driving signal COM-A.

The other end of the capacitor C20 is connected to the pin Ifb of the LSI 500. Thus, a direct-current component in the high-frequency component of the driving signal COM-A passing through the BPF is cut and the driving signal COM-A is feedback to the pin Ifb.

Incidentally, the driving signal COM-A output from the terminal Out is a signal obtained when the lowpass filter formed by the inductor L2 and the capacitor C10 smoothes the amplified modulated signal in the connection point (the pin Sw) of the transistors M3 and M4. The driving signal COM-A is integrated and subtracted via the pin Vfb, and then is positively feedback to the adder 504. Therefore, the driving signal COM-A is subjected to self-excited oscillation at a frequency decided by delay of the feedback (a sum of delay occurring in the smoothing of the inductor L2 and the capacitor C10 and delay occurring in the integral attenuator 512) and a transfer function of the feedback.

However, since the delay amount of a feedback route via the pin Vfb is large, the frequency of the self-excited oscillation may not be set to be high enough to ensure the accuracy of the driving signal COM-A sufficiently only in the feedback via the pin Vfb.

Accordingly, in the embodiment, apart from the route via the pin Vfb, a route in which the high-frequency component of the driving signal COM-A is feedback via the pin Ifb is provided so that the delay decreases from the viewpoint of the entire circuit. Therefore, the frequency of the signal As obtained by adding the high-frequency component of the driving signal COM-A to the signal Ab is increased so that the accuracy of the driving signal COM-A can be sufficiently ensured, compared to a case in which a route via the pin Ifb is not present.

Figure 11:
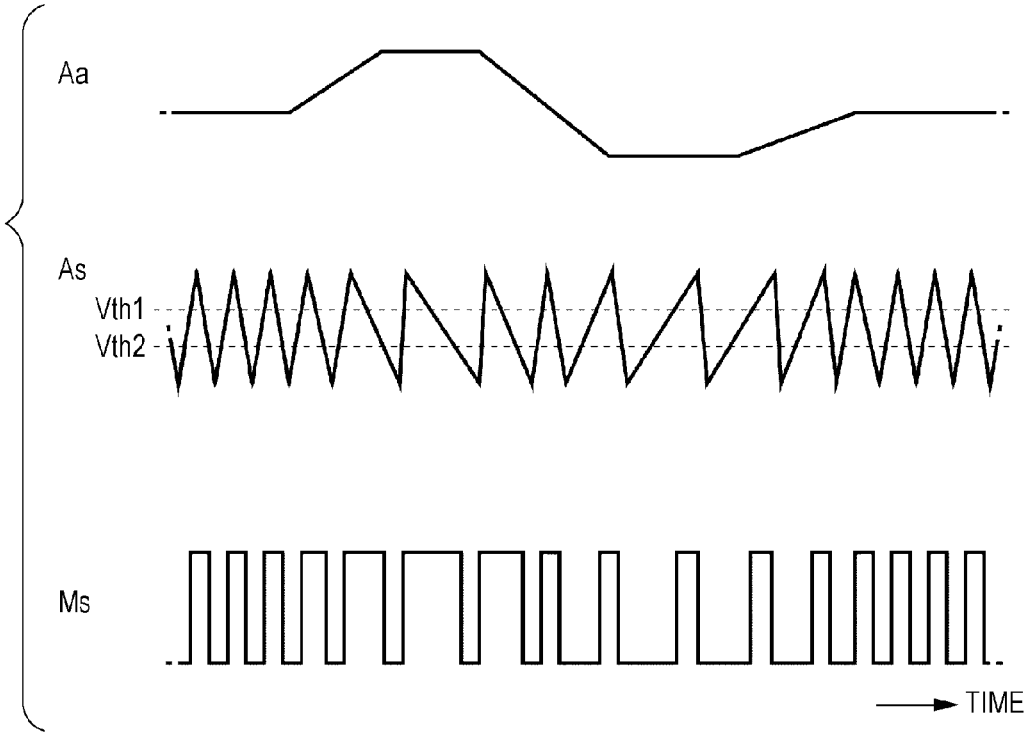
FIG. 11 is a diagram for describing an operation of the driving circuit.

FIG. 11 is a diagram illustrating the waveforms of the signal As and the modulated signal Ms in association with the waveform of the analog signal Aa.

As illustrated in the drawing, the signal As is a triangular wave and its oscillation frequency varies according to a voltage (input voltage) of the analog signal Aa. Specifically, when the input voltage is an intermediate value, the oscillation frequency increases. When the input voltage increases or decreases from the intermediate value, the oscillation frequency decreases.

The slope of the triangular wave of the signal As is approximately identical between a rise (increase in the voltage) and a fall (decrease in the voltage), when the input voltage is near the intermediate value. Therefore, a duty ratio of the modulated signal Ms which is a result obtained by comparing the signal As to the voltage threshold values Vth1 and Vth2 by the comparator 520 is approximately 50%. When the input voltage increases from the intermediate value, the slope of the fall of the signal As becomes gentle. Therefore, a period in which the modulated signal Ms is in the H level is relatively lengthened, and thus the duty ratio increases. Conversely, when the input voltage decreases from the intermediate value, the slope of the rise of the signal As becomes gentle. Therefore, a period in which the modulated signal Ms is in the L level is relatively shortened, the duty ratio decreases.

Therefore, the modulated signal Ms becomes the following pulse density modulated signal. That is, the duty ratio of the modulated signal Ms is approximately 50% at the intermediate value of the input voltage. When the input voltage increases from the intermediate value, the duty ratio increases. When the input voltage decreases from the intermediate value, the duty ratio decreases.

The gate driver 533 turns on and off the transistor M3 based on the modulated signal Ms. That is, the gate driver 533 turns on the transistor M3 when the modulated signal Ms is in the H level and turns off the transistor M3 when the modulated signal Ms is in the L level. The gate driver 534 turns on and off the transistor M4 based on a logic conversion signal of the modulated signal Ms. That is, the gate driver 534 turns off the transistor M4 when the modulated signal Ms is in the H level and turns on the transistor M4 when the modulated signal Ms is in the L level.

Accordingly, the voltage of the driving signal COM-A obtained by smoothing the amplified modulated signal at the connection point of the transistors M3 and M4 by the inductor L2 and the capacitor C10 increases as the duty ratio of the modulated signal Ms increases and decreases as the duty ratio thereof decreases. Consequently, the driving signal COM-A is controlled to become a signal in which the voltage of the analog signal Aa is expanded, and then is output.

Since the driving circuit 50 uses the pulse density modulation, there is the advantage in which a change width of the duty ratio is larger than that in pulse width modulation in which a modulation frequency is fixed.

That is, since the minimum positive pulse width and the minimum negative pulse width which can be handled in the entire circuit are restricted due to the circuit characteristics, only a predetermined range (for example, a range from 10% to 90%) may be ensured as the change width of the duty ratio in the pulse width modulation in which the frequency is fixed. In the pulse density modulation, however, the oscillation frequency is lowered as the input voltage becomes distant from the intermediate value. Therefore, the duty ratio can be increased in a region in which the input voltage is high. The duty ratio can be decreased in a region in which the input voltage is low. Thus, in the self-excited oscillation type pulse density modulation, a broader range (for example, a range from 5% to 95%) can be ensured as the change width of the duty ratio.

The driving circuit 50 is a self-excited oscillation circuit, and thus a circuit generating carrier waves with a high frequency is not necessary as in separate-excited oscillation. Therefore, there is the advantage in which a portion other than a circuit handling a high voltage, that is, a portion of the LSI 500 is easily integrated.

Additionally, in the driving circuit 50, not only the route in which the high-frequency component is feedback via the pin Vfb but also the route via the pin Ifb are present as the feedback routes of the driving signal COM-A. Therefore, the delay is small from the viewpoint of the entire circuit. Thus, since the frequency of the self-excited oscillation increases, the driving circuit 50 can generate the driving signal COM-A with high accuracy.

Such a driving circuit 50 is configured by mounting various elements such as capacitors and resistors on a multi-layer printed circuit substrate. Next, a state in which various elements are mounted on a printed circuit substrate and routing of wires in the printed circuit substrate will be described.

The printed circuit substrate is a four-layer substrate. As will be described below, the printed circuit substrate has a structure in which wiring patterns from a first layer to a fourth layer are stacked with insulation layers interposed therebetween and the wiring patterns of the different layers are electrically connected via through holes appropriately. In the description, the layers are not insulation layers, but are constituent layers of the wiring patterns formed in the interfaces of the insulation layers.

Figure 12:
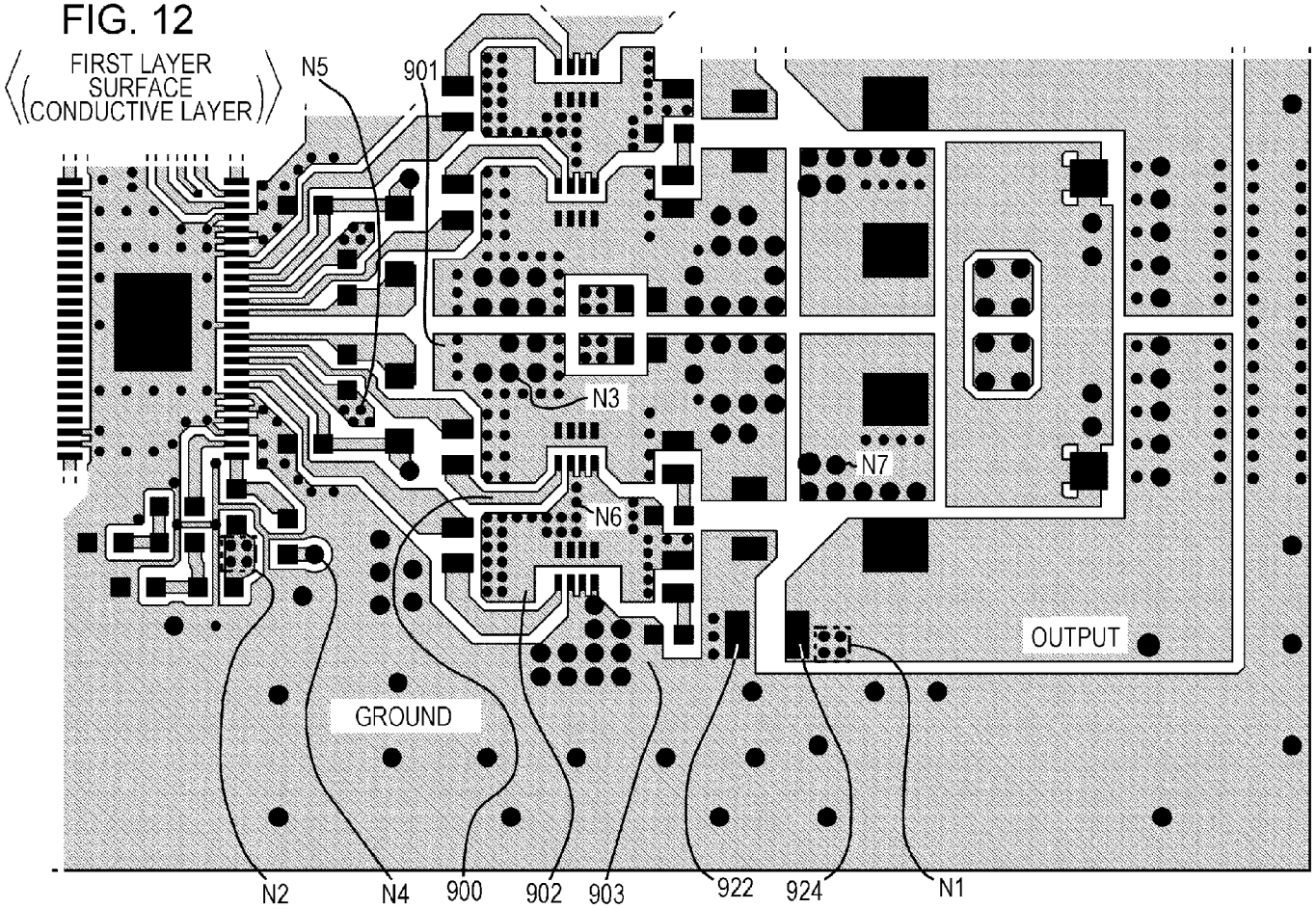
FIG. 12 is a diagram illustrating a wiring pattern of a first layer of a printed circuit substrate.
Figure 13:
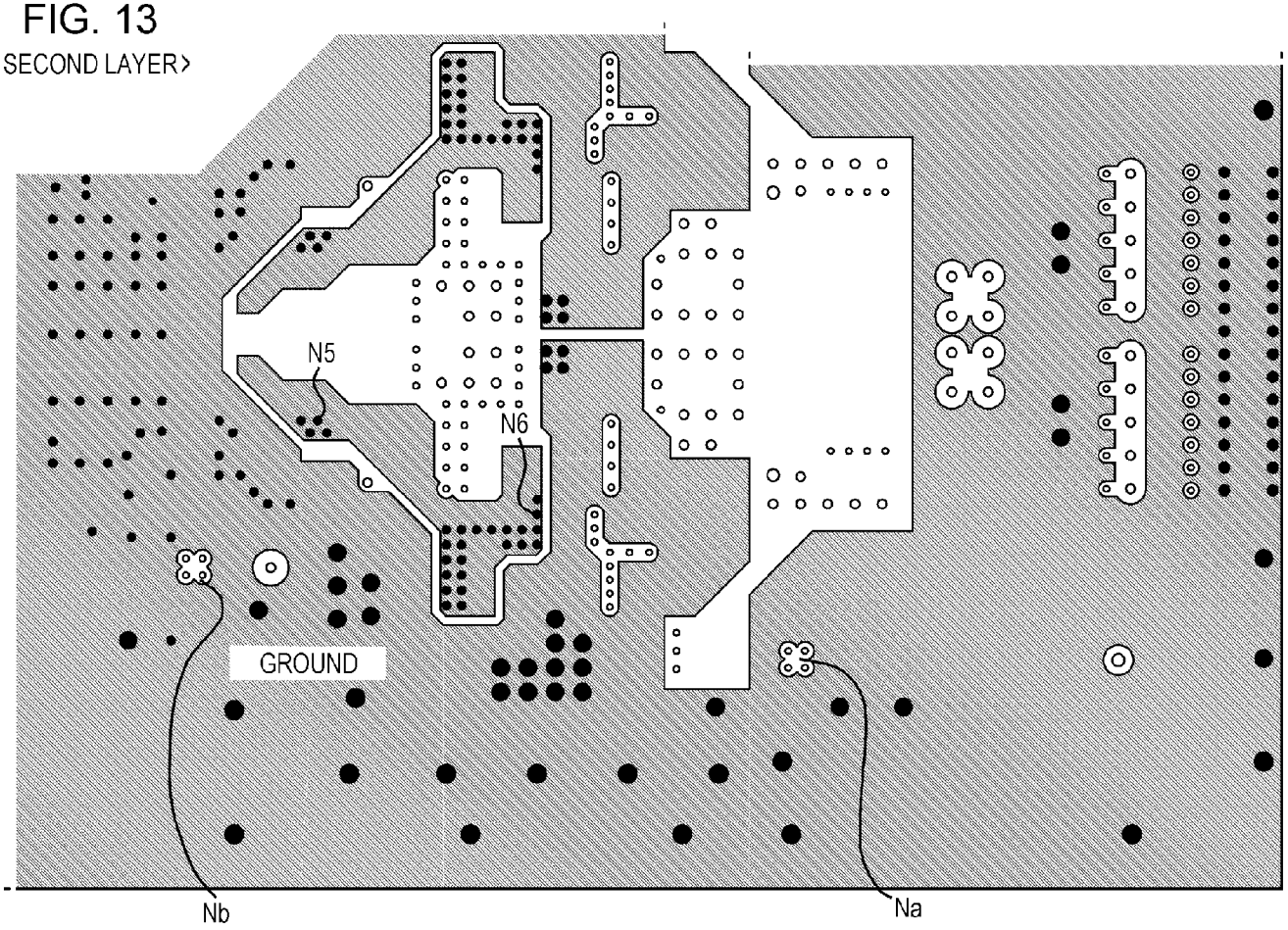
FIG. 13 is a diagram illustrating a wiring pattern of a second layer of the printed circuit substrate.
Figure 14:
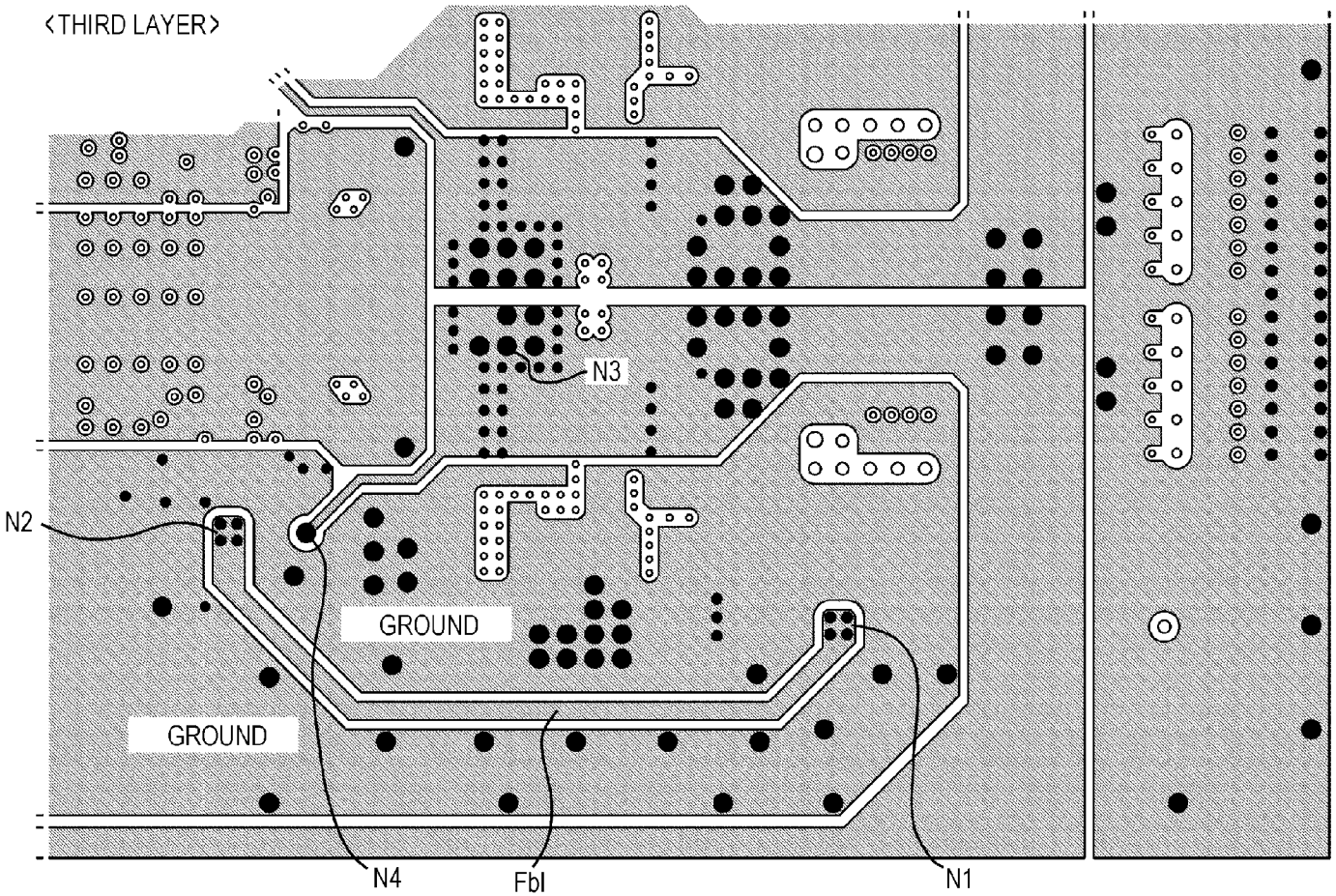
FIG. 14 is a diagram illustrating a wiring pattern of a third layer of the printed circuit substrate.
Figure 15:
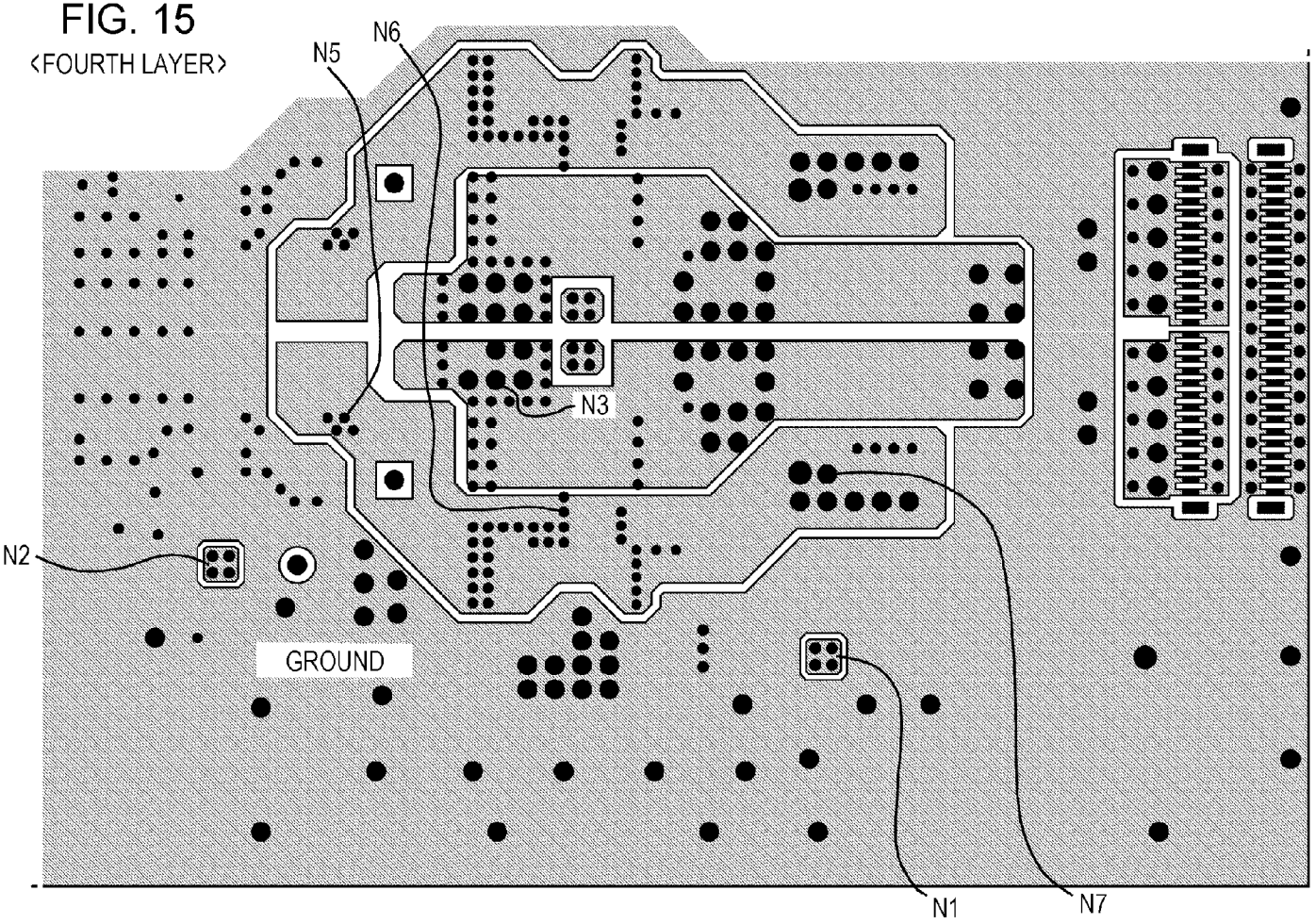
FIG. 15 is a diagram illustrating a wiring pattern of a fourth layer of the printed circuit substrate.

FIG. 12 is a diagram illustrating the wiring pattern of the first layer in the vicinity of a constituent region of the driving circuit 50 in the printed circuit substrate. Likewise, FIGS. 13 to 15 are diagrams illustrating the wiring patterns of the second, third, and fourth layers in the printed circuit substrate.

In FIGS. 12 to 15, the first, second, third, and fourth layers are names given to the four layers of the printed circuit substrate conveniently in order from a mounted surface. Therefore, the first and fourth layers are surface layers and the second and third layers are layers other than the surface layers. FIGS. 12 to 15 all illustrate states in a plan view of the printed circuit substrate from the mounted surface.

In FIGS. 12 to 15, regions hatched by diagonal lines are wiring patterns in which copper foils are patterned. Here, in the wiring pattern of a certain layer, a circular region painted with black is a through hole (via) connecting the wiring pattern of this layer to the wiring pattern of another layer. In each layer, a region with no hatching is a region in which the wiring pattern is not formed. In the region, a white circular portion indicates an opening portion of a through hole which is formed to connect the wiring patterns of the different layers to each other without being connected to the wiring pattern of the certain layer.

In the wiring pattern of the first layer in FIG. 12, a rectangular region painted with black is a contact (referred to as a connection portion or a land in the printed circuit substrate rather than a terminal) connecting various elements. The wiring patterns of the surface layers, the first and fourth layers, are protected with a solder resist (not illustrated), except for the through holes and the contacts. In other words, the contacts and the through holes in the printed circuit substrate can also be exposed portions of the wiring patterns.

Figure 16:
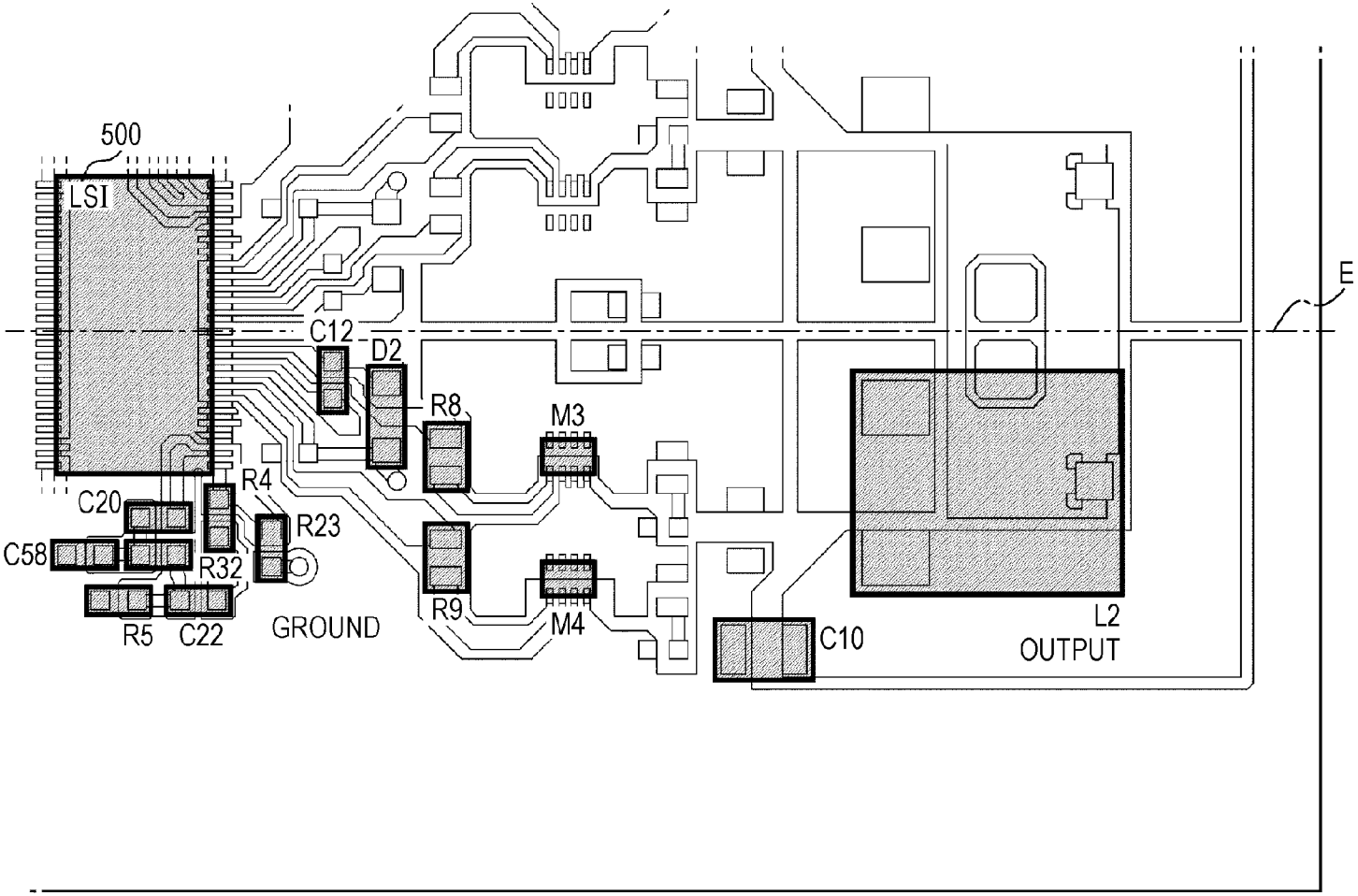
FIG. 16 is a diagram illustrating disposition of elements in the printed circuit substrate.
Figure 17:
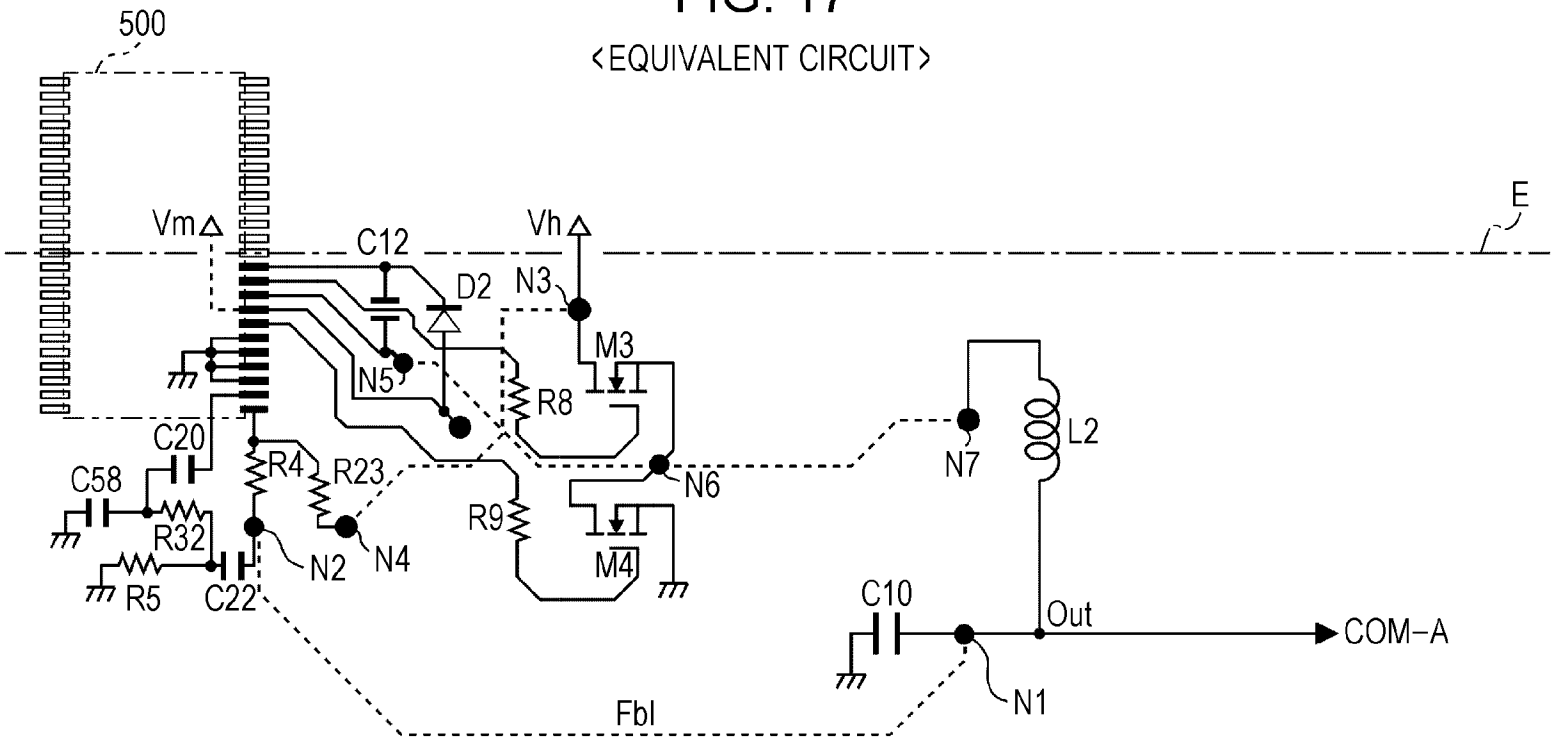
FIG. 17 is a diagram illustrating an equivalent circuit of the driving circuit in the printed circuit substrate.
Figure 18:
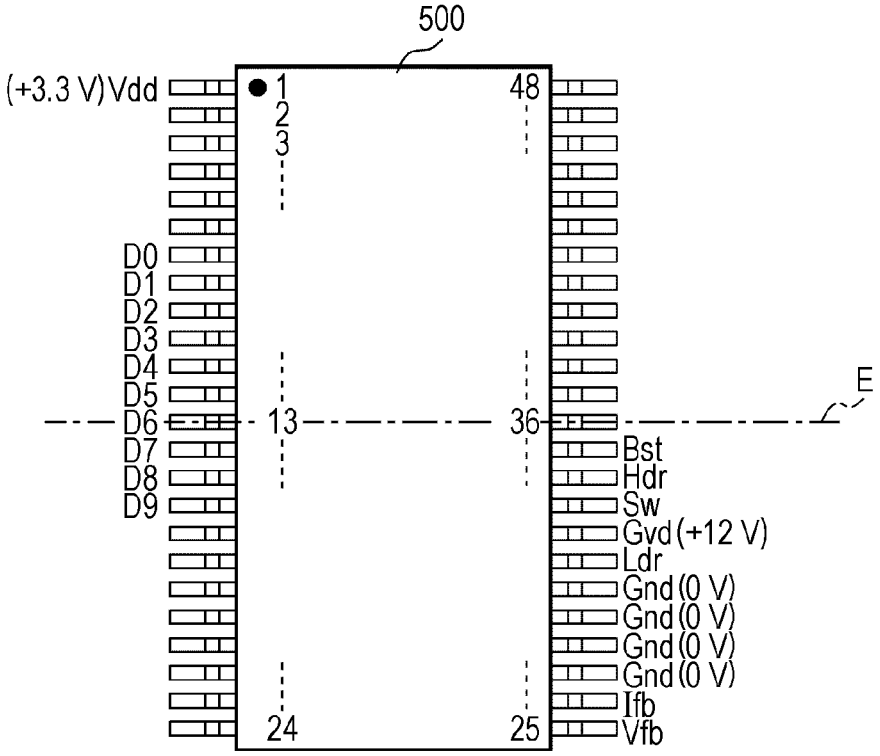
FIG. 18 is a diagram illustrating assignment of pins of an LSI in the driving circuit.

FIG. 16 is a plan view illustrating disposition of elements included in the driving circuit 50 in the printed circuit substrate. FIG. 17 is a diagram illustrating an equivalent circuit of the driving circuit 50 based on a relation with the disposition of the elements mounted on the printed circuit substrate. FIG. 18 is a diagram illustrating assignment of the pins of the LSI 500, that is, assignment of the pins arranged in dual in-lines.

In FIGS. 12 to 17, scales are aligned to show the plan configuration of the printed circuit substrate. In FIG. 18, however, the scales in FIGS. 12 to 17 are enlarged to facilitate the description. For pin numbers of the LSI 500, the pin indicated by the circle painted with black in the top right of FIG. 18 is number "1" and pin numbers "2," "3," "4," . . . , and "48" are given counterclockwise using the pin with number 1 as a criterion.

Of the wirings of the equivalent circuit illustrated in FIG. 17, solid lines indicate that the wiring pattern of the first layer (see FIG. 12) is configured and dashed lines indicate that the wiring patterns of the second to fourth layers are configured.

The terminal Out which is a connection portion of the other end of the inductor L2 and the one end of the capacitor C10 is connected to one end of a feedback wiring pattern Fbl (see FIG. 14) via the through hole N1.

Figure 19:
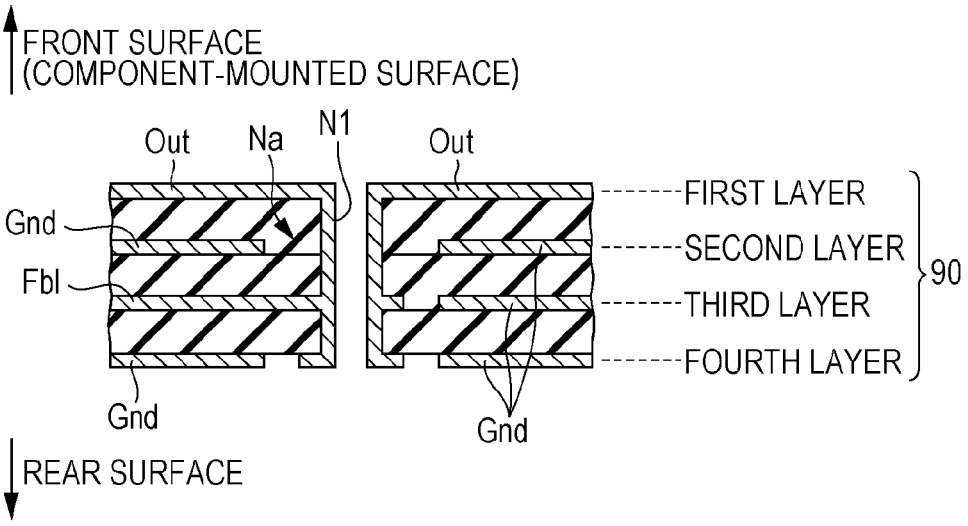
FIG. 19 is a sectional view illustrating the structure of a through hole in the printed circuit substrate.

FIG. 19 is a partial sectional diagram illustrating the structure of a printed circuit substrate in the vicinity of a through hole N1.

A printed circuit substrate 90 has a structure in which wiring patterns of first to fourth layers and insulation resins formed of glass epoxy or the like are stacked. In the through hole N1, the wiring pattern of the first layer including the terminal Out is connected to one end of the feedback wiring pattern Fbl formed from the wiring pattern of the third layer via a through hole.

In the second layer, a wiring pattern connected to the terminal Out (the feedback wiring pattern Fbl) via the through hole N1 is not present. Therefore, the wiring pattern of a ground of the second layer is patterned so that the wiring pattern does not come into contact with a through portion of the through hole N1 in a region Na (also see FIG. 13).

The other end of the feedback wiring pattern Fbl is connected to the one end of the resistor R4 and the one end of the capacitor C12 in the wiring pattern of the first layer via a through hole N2 (see FIG. 17). The cross-sectional structure of the through hole N2 is substantially the same as that of the through hole N1, and thus is not illustrated. The wiring pattern of the ground of the second layer is patterned so that the wiring pattern does not come into contact with a through portion of the through hole N2 in a region Nb, as illustrated in FIG. 13.

In the driving circuit 50, two routes, a route from the terminal Out to the pin Vfb and a route from the terminal Out to the pin Vfb, are formed as the feedback routes. Of the feedback routes, the feedback wiring pattern Fbl is a wiring pattern shared between the two routes and refers to a wiring pattern formed in the third layer from the through N1 to the through hole N2.

The through holes N1 and N2 and the like are not singular. As understood with reference to FIG. 12 or the like, a plurality of through holes, four through holes, are formed in practice in terms of the through holes N1 and N2, but there is no meaning that the through holes are distinguished from each other one by one in the viewpoint from the functions.

Therefore, the plurality of through holes are indicated collectively below without distinguishing the through holes from each other in some cases.

As illustrated in FIG. 14, the feedback wiring pattern Fbl of the third layer is surrounded by the wiring pattern of the ground. In a plan view of the feedback wiring pattern Fbl of the third layer, both of the wiring patterns of the second layer (see FIG. 13) and the fourth layer (see FIG. 15) overlapping with the feedback wiring pattern Fbl in a plan view are the grounds.

Therefore, the feedback route is shielded with the wiring pattern of the ground in a substrate planar direction by the same wiring pattern of the third layer and is also shielded with the wiring pattern of the ground in a substrate vertical direction by the wiring patterns of the second and fourth layers.

On the other hand, in the circuit diagram of FIG. 10, the feedback route is branched into two systems from the terminal Out and is feedback to the pins Vfb and Ifb of the LSI 500. However, in practice, as illustrated in FIG. 17, the feedback route is directed from the terminal Out of the first layer to the feedback wiring pattern Fbl via the through hole N1, is directed to the first layer again via the through hole N2 in front of the LSI 500 again, and is branched into the one end of the resistor R4 and the one end of the capacitor C22. Of the branched routes, the rough on the side of the resistor R4 is feedback to the pin Vfb and the route on the side of the capacitor C22 is feedback to the pin Ifb.

The region in which the resistor R4 along the route branched to the pin Vfb is disposed is surrounded by the pattern of the ground in the first layer. The pattern of the ground is interpolated between the contacts of the one end and the other end of the resistor R4. The same also applies to the resistor R23 pulling up the pin Vfb, the disposed region is surrounded by the pattern of the ground, and the pattern of the ground is interpolated between the contacts.

In the route branched to the pin Ifb, the resistor R32 and the capacitor C20 are present in addition to the capacitor C22. Likewise, a region in which such elements are disposed is also surrounded by the pattern of the ground and the pattern of the ground is interpolated between the contacts.

Since the other ends of the resistor R5 and the capacitor C58 become the ground, the pattern of the ground is interpolated between the contacts.

Here, wiring patterns 900, 901, 902, and 903 (see FIG. 12 for all of the wiring patterns) of the first layer will be described to facilitate the description. The wiring pattern 900 connects the other end of the resistor R8 to the gate electrode of the transistor M3.

The wiring pattern 901 applies the voltage Vh to the drain electrode of the transistor M3. The wiring pattern 901 is connected to the wiring pattern of the third layer and the wiring pattern of the fourth layer via a through hole N3.

The wiring pattern 902 connects the source electrode of the transistor M3 to the drain electrode of the transistor M4. The wiring pattern 902 is connected to the wiring pattern of the second layer and the wiring pattern of the fourth layer via a through hole N6. The wiring pattern 903 is a ground and is connected to the source electrode of the transistor M3.

As described above, the drain electrode of the transistor M3 is connected to the wiring pattern of the third layer and the wiring pattern of the fourth layer via the through hole N3. Of the wiring patterns, the wiring pattern of the third layer is connected to the other end of the resistor R4 by the wiring pattern of the first layer via a through hole N4.

The other end (the pin Sw) of the capacitor C12 is connected to the wiring patterns of the second and fourth layers via a through hole N5. The wiring patterns of the second and fourth layers are connected to the source electrode of the transistor M3 and the drain electrode of the transistor M4 in the first layer via the through hole N6. That is, these wiring patterns are connected to the wiring pattern 902.

In FIG. 15, the wiring pattern of the fourth layer connected to the other end of the capacitor C12 via the through hole N5 is connected to one end of the inductor L2 in the first layer via the through hole N7.

Therefore, the wiring patterns of the second and fourth layers are connected in parallel between the through holes N5 and N6 and sole connection by the wiring pattern of the fourth layer is made between the through holes N6 and N7.

In the driving circuit 50, the transistors M3 and M4 are turned on and off (switched), so that a spike current of about a few amperes flows from the terminal Out which is an output to the ground via the capacitor C10. Therefore, noise caused due to the spike current is superimposed on the ground.

Here, in the embodiment, the vicinities of the feedback wiring pattern Fbl and the two routes reaching from the through hole N2, which connects the other end of the feedback wiring pattern Fbl, to the pins Vfb and Ifb are shielded with the ground. Therefore, since the elements along the feedback route and the element of which one end is connected to the feedback route operate using the ground as a criterion, the influence of the noise is reduced. Accordingly, in the embodiment, an erroneous operation does not occur due to the influence of the noise. The driving signal COM-A with high accuracy with respect to the signal Aa which is a target signal can be generated and output.

In the driving circuit 50, the example in which the driving signal COM-A is generated has been described, but the driving circuit 50 generating the driving signal COM-B is also the same as the driving circuit 50 generating the driving signal COM-A. In the printed circuit substrate, as partially illustrated in FIGS. 12 to 15, the driving circuit generating the driving signal COM-B and the driving circuit 50 generating the driving signal COM-A are configured in a symmetric pattern using an imaginary straight line E (see FIGS. 16, 17, and 18) extending and binding the pin 13 and the pin 36 of the LSI 500 as a criterion (excluding some of the wiring patterns and the through holes).

When the LSI 500 outputs gate signals of not only the driving signal COM-A but also the driving signal COM-B, for example, the data dA and the data dB are input to, for example, D0 to D9 in a time division manner.

Next, the structure of the transistor M3 (M4) will be described. The same performance, for example, the performance of the same model number, is used in the transistors M3 and M4. Therefore, the transistor M3 of the high side will be described here.

Figure 20A:
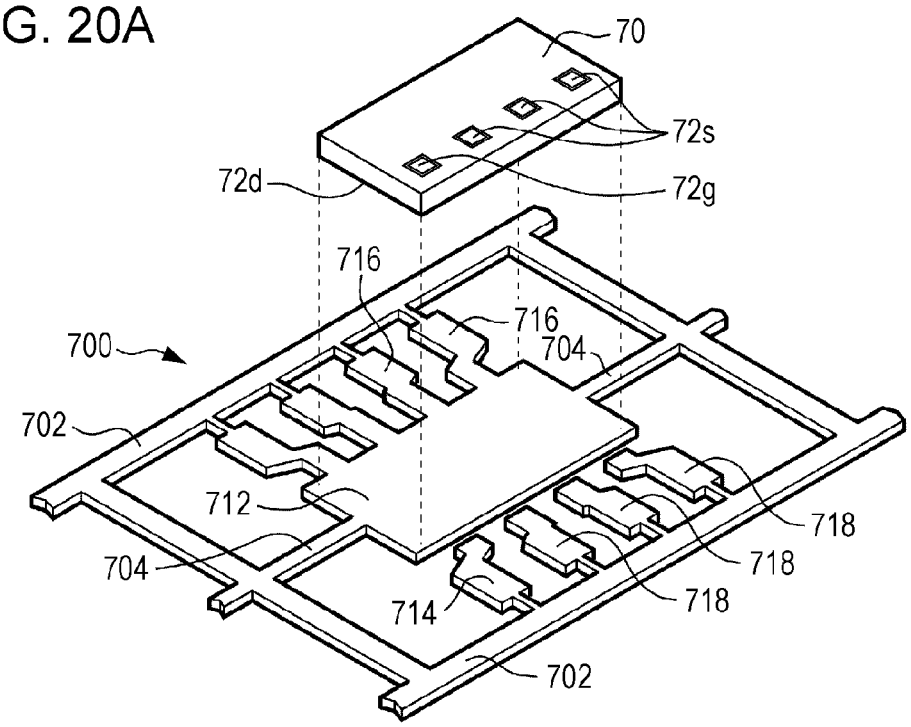
FIGS. 20A and 20B are expanded diagrams illustrating the periphery of a transistor in the printed circuit substrate.
Figure 20B:
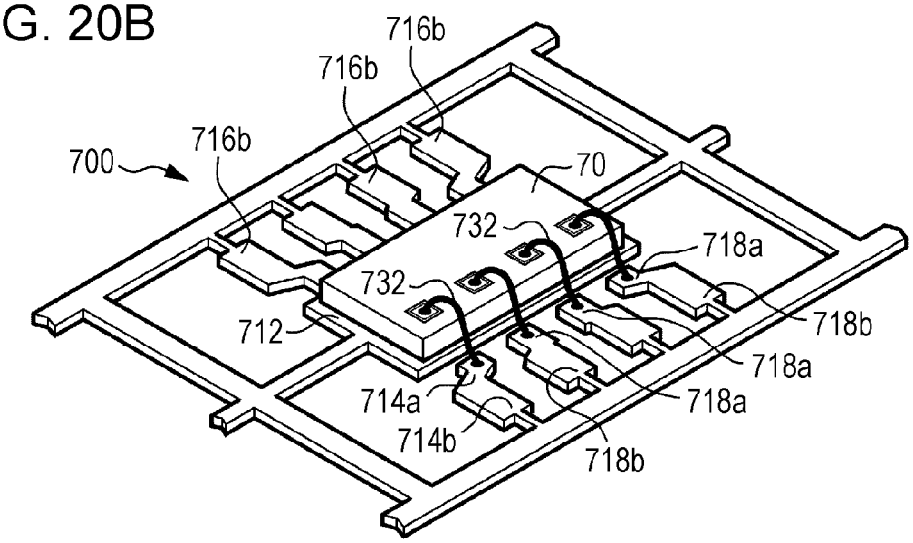
Figure 21:
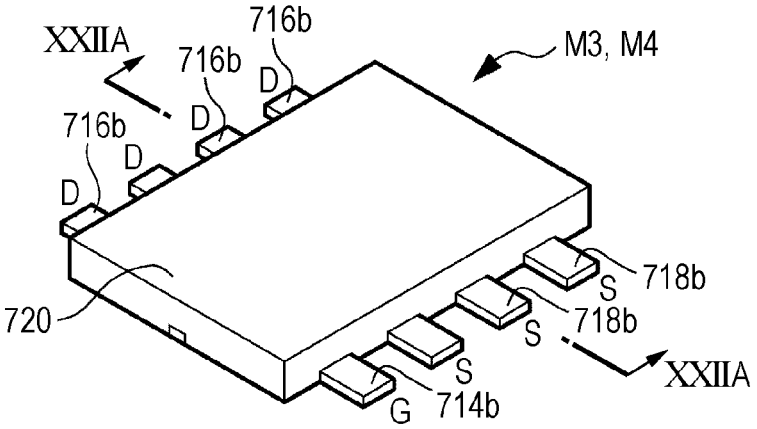
FIG. 21 is a perspective view illustrating the outer appearance of the transistor.

FIGS. 20A and 20B are exploded perspective views for describing the structure of the transistor M3. FIG. 21 is a perspective view illustrating the outer appearance of the transistor M3.

As illustrated in FIG. 21, the transistor M3 is a display-surface-mounted package in which pins of two row and four columns are arranged. In assignment of the pins, all of four pins in one row are drains (D), one pin of the four pines of the other row is a gate (G), and the remaining three pins of the other row are sources (S).

When the structure of the transistor M3 is described, a lead frame 700 in which a die 70 is die-bonded will be first described.

As illustrated in FIG. 20A, in the lead frame 700, a die pad 712 with a larger rectangular shape than the die in a plan view is connected to an outer frame 702 via tie-bars 704 on both shorter sides and leads 716 of a longer side on the one row side. The die pad 712 is not connected to leads 714 and 718 of a longer side on the other row side. That is, the leads 714 and 718 are not connected to the die pad 712 and are connected only to the outer frame 702 unlike the leads 716 on the one row side.

On the other hand, in the die 70, a drain pad 72d (first electrode) is formed on the bottom surface in the drawing and one gate pad 72*g* (second electrode) and three source pads 72*s* (third electrodes) are formed on the top surface of the other side.

In the die 70, as illustrated in FIGS. 20A and 20B, the bottom surface is die-bonded to the die pad 712. Thus, the drain pad 72*d* and the die pad 712 are electrically connected.

As illustrated in FIG. 20B, the gate pad 72*g* and an inner lead 714*a* are electrically connected by a bonding wire 732. Likewise, the source pads 72*s* and inner leads 718a are electrically connected by bonding wires 732.

Thereafter, although not illustrated particularly, a resin 720 is molded as follows. That is, the resin 720 is molded so that the die 70, the inner leads 714*a* and 718*a*, and the bonding wires 732 are covered and the bottom surface of the die pad 712 and outer leads 714*b*, 716*b*, and 718*b* are exposed.

After the resin 720 is molded in this way, the outer leads 714*b*, 716*b*, and 718*b* (the tie-bars 704) are detached from the outer frame 702 to have a shape illustrated in FIG. 21.

Therefore, in the transistor M3, the outer lead 714 which is a first lead serves as a gate electrode, the die pad 712 and the outer leads 716*b* serve as a drain electrode, and the outer leads 718 which are second leads serve as a source electrode.

Figure 22A:
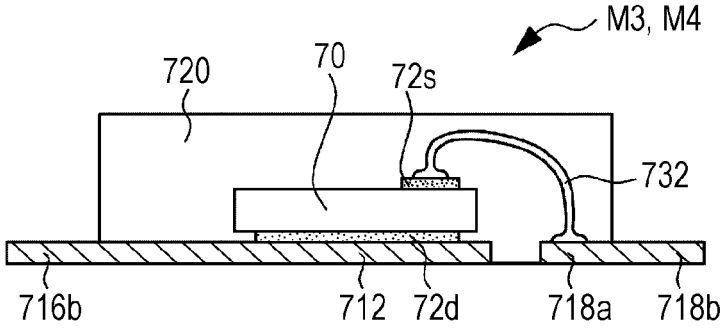
Figure 22B:
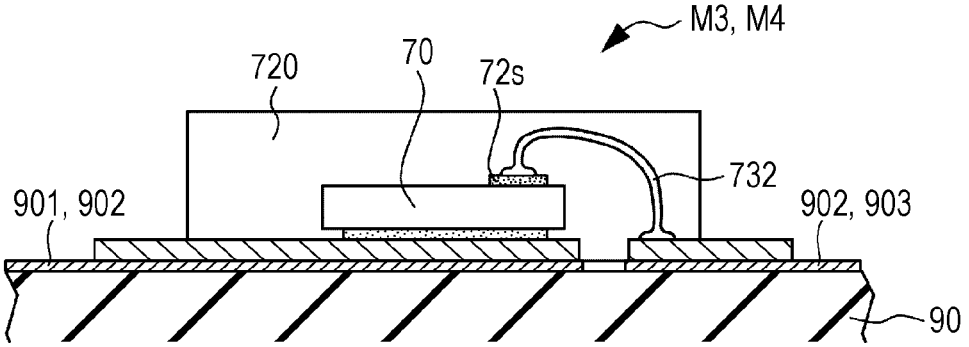

FIG. 22A is a sectional view illustrating the transistor M3 taken along the line XXIIA-XXIIA of FIG. 21. FIG. 22B is a diagram illustrating a state in which the transistor M3 is mounted on the printed circuit substrate 90.

As illustrated in the drawings, the transistor M3 is bonded on the wiring patterns of the printed circuit substrate 900 as follows. That is, the die pad 712 and the outer leads 716*b* serving as the drain electrode are bonded on the wiring pattern 901 and the outer leads 718*b* serving as the source electrode are bonded on the wiring pattern 902. Although not illustrated in FIG. 22B, the outer lead 714*b* serving as the gate electrode is bonded on the wiring pattern 900 (see FIG. 12).

The transistor M3 has been described herein, but the same also applies to the transistor M4. In the case of the transistor M4, as indicated by parentheses in FIG. 22B, the die pad 712 and the outer leads 716*b* serving as the drain electrode are bonded on the wiring pattern 902 and the outer leads 718*b* serving as the source electrode are bonded on the wiring pattern 903. The outer lead 714*b* serving as the gate electrode is bonded on the wiring pattern including the other end of the resistor R8 in FIG. 17.

Figure 23:
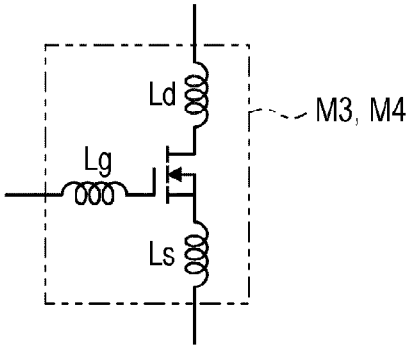
FIG. 23 is a diagram illustrating an equivalent circuit of the transistor.

FIG. 23 is a diagram illustrating a general equivalent circuit of a transistor without being limited to the transistor M3 (M4). As illustrated in the drawing, an inductance component is parasitized in series in each electrode of the transistor. Specifically, an inductance Lg is parasitized in the gate electrode of the transistor, an inductance Ld is parasitized in the drain electrode, and an inductance Ls is parasitized in the source electrode. In the transistor, resistance or a capacitance component is parasitized in each electrode, but is not illustrated.

Figure 24A:
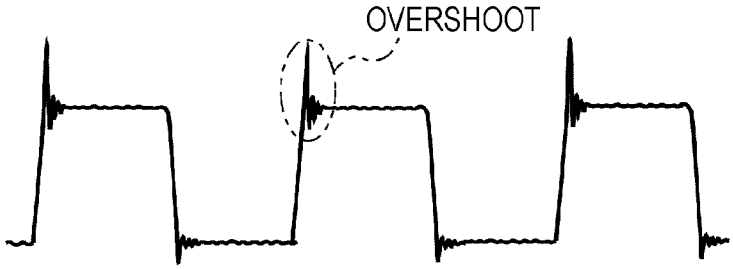
FIGS. 24A and 24B are diagrams illustrating overshoot by switching of the transistor.

In order to generate the driving signal COM-A as in the embodiment, a current suddenly flows or is cut off between the drain electrode and the source electrode when the transistors M3 and M4 are switched. When the inductances parasitized in each electrode of the transistor M3 (M4), particularly, the inductances Ld and Ls, are large, voltage noise such as overshoot (undershoot) is generated in the voltage waveform of the electrode between the drain and source, as illustrated in FIG. 24A.

When L is assumed to be a sum of the inductances Ld and Ls, a voltage V between the drain and the source is L (di/dt) and the voltage noise depends on not only the inductance L but also a frequency.

In order to generate the driving signal COM-A (COM-B) with high accuracy, a situation in which the voltage noise is easily generated may occur when the transistor M3 and M4 are switched at a high frequency.

When such voltage noise occurs, the noise component is smoothed along with a normal pulse component by the inductor L2 and the capacitor C10 and is input to the pins Vfb and Ifb of the LSI 500 via the feedback route. Therefore, when the modulated signal Ms is generated, an error is caused. Therefore, wrong switching (for example, double trigger in which both of the transistors are simultaneously turned on) of the transistors M3 and M4 may be caused, so that not only waveform accuracy of the driving signal COM-A, which is an output, may deteriorate, but also power consumed in the driving circuit 50 may increase.

Figure 24B:
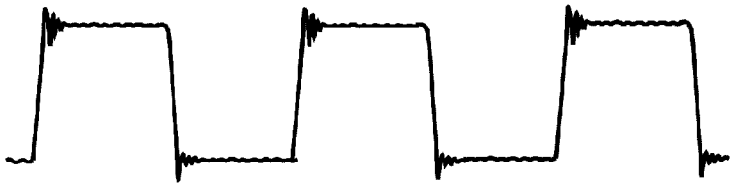

In the driving circuit 50 applied to the printing apparatus 1 according to the embodiment, the drain pad 72*d* of the transistor M3 is connected to the wiring pattern 901 of the printed circuit substrate 90 via the die pad 712 and the outer leads 716*b*. Therefore, in the transistor M3 (M4), the inductance component parasitized in the drain is smaller than in a type in which a bonding wire or a lead are included. As illustrated in FIG. 24B, occurrence of the overshoot or the like can be suppressed. Accordingly, in the driving circuit 50, it is possible to prevent a deterioration in the waveform accuracy of the driving signal COM-A and an increase in power consumption.

Heat generated in the die 70 of the transistor M3 (M4) transfers to the printed circuit substrate 90 via the die pad 712 and the outer leads 716*b* to be dissipated.

Here, in the printed circuit substrate 90, the wiring pattern 901 to which the die pad 712 and the outer leads 716*b* of the transistor M3 are connected is connected to the wiring patterns of the third layer (see FIG. 14) and the fourth layer (see FIG. 15) via the through hole N3. The wiring pattern 902 to which the die pad 712 and the outer leads 716*b* of the transistor M4 are connected is connected to the wiring patterns of the second layer (see FIG. 13) and the fourth layer via the through hole N6. Therefore, efficiency of heat dissipation can be improved even in the printed circuit substrate 90.

As described above, when the dots with the different sizes are formed on the printing medium P, it is necessary to shorten a time in which one-time ink droplet is ejected once. That is, since it is necessary to increase the ink ejection frequency f, a problem of heat generation or noise may easily occur. In the embodiment, however, it is possible to efficiently suppress the heat generation or the noise particularly in the transistors M3 and M4.

Next, the disposition and mounting of the capacitor C10 in the printed circuit substrate 90 will be described.

Figure 25:
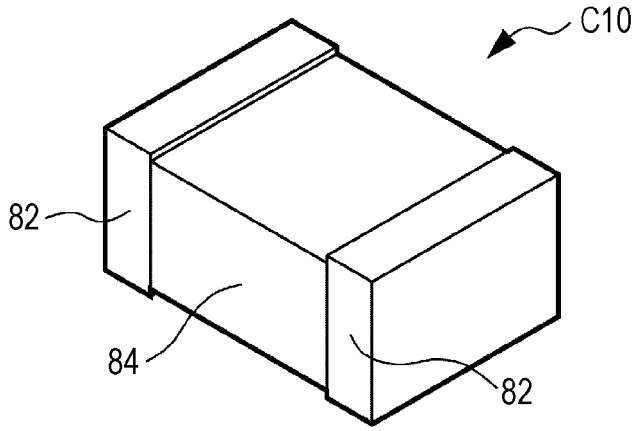
FIG. 25 is a diagram illustrating the configuration of a capacitor included in a smoothing filter.
Figure 26:
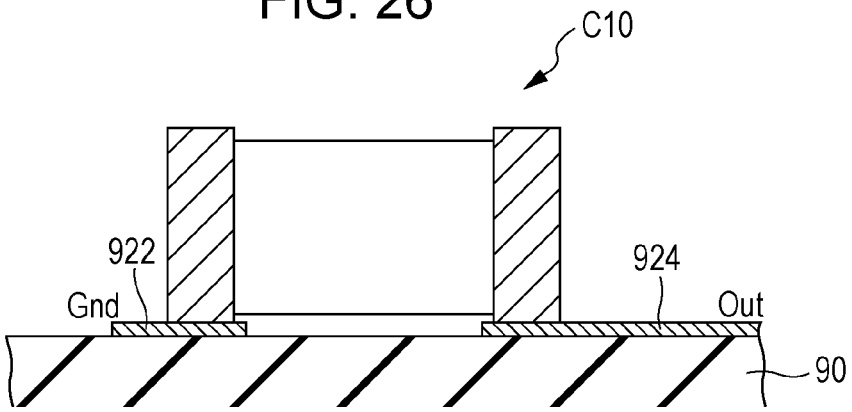

FIG. 25 is a perspective view illustrating the outer configuration of the capacitor C10. FIG. 26 is a sectional view illustrating a state in which the capacitor C10 is mounted.

As illustrated in the drawings, the capacitor C10 is a so-called chip capacitor is surface-mounted on the printed circuit substrate 90 and has a configuration in which a dielectric 84 is interposed between two external electrodes 82. The internal structure of the capacitor C10 is not particularly illustrated and will not be described in detail. However, for example, a laminated ceramic chip capacitor in which a dielectric layer and a pair of external electrodes 82 formed in a pectinated shape are alternately laminated is used.

As illustrated in FIG. 26, in the capacitor C10, one of the external electrodes 82 is connected to a terminal 922 of the wiring pattern including the terminal Out and the other thereof is connected to a terminal 924 of the wiring pattern of the ground.

Figure 27:
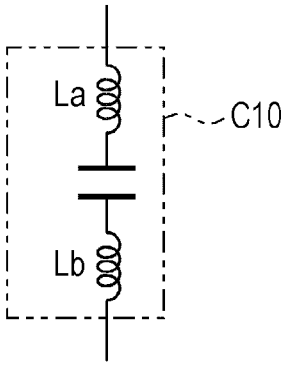
FIG. 27 is a diagram illustrating an equivalent circuit of the capacitor.

FIG. 27 is a diagram illustrating a general equivalent circuit of a capacitor without being limited to the capacitor C10.

As illustrated in the drawing, inductances La and Lb are parasitized in series in the electrodes of the capacitor. Further, resistance or a capacitance component is parasitized in each electrode, but is not illustrated.

The capacitor C10 smoothes the amplified modulated signal, that is, a switching current, in the connection point (the pin Sw) of the transistors M3 and M4 along with the inductor L2. Therefore, when the inductor component parasitized in the capacitor C10 is large, voltage noise such as overshoot occurs as in the transistors M3 and M4. When the voltage noise is input to the pins Vfb and Ifb of the LSI 500 via the feedback route, wrong switching of the transistors M3 and M4 may be caused, so that not only the waveform accuracy of the driving signal COM-A may deteriorate, but also power consumed in the driving circuit 50 may increase, as in the transistors M3 and M4.

In the driving circuit 50 applied to the printing apparatus 1, the capacitor C10 is a type of capacitor with no lead, that is, a leadless chip capacitor in which one of the two external electrodes 82 is soldered to the terminal 922 of the printed circuit substrate 90 and the other external electrode 82 is soldered to the terminal 924. Therefore, since the inductances La and Lb are smaller than in a type of capacitor with a lead and the occurrence of the overshoot or the like is suppressed, it is possible to prevent the deterioration in the waveform accuracy of the driving signal COM-A or the increase in the power consumption.

The capacitor C10 is disposed in the printed circuit substrate 90 as follows. That is, as illustrated in FIG. 16, the capacitor C10 is mounted on the printed circuit substrate 90 so that a straight line F imaginarily binding one pair of external electrodes 82 of the capacitor C10 is substantially parallel to the straight line E in a plan view.

Of the two external electrodes 82, the external electrode 82 connected to the terminal 922 of the ground further faces the side of the LSI 500 than the external electrode 82 connected to the terminal Out. Of the two terminals connected to the capacitor C10, the terminal 922 of the ground is closer to the LSI 500 than the terminal 924 which is an output in the driving circuit 50 in view of the printed circuit substrate 90. Therefore, impedance of the ground reading from the terminal 922 to the LSI 500 is small.

In the driving circuit 50, as described above, a spike current of about a few amperes flows in the ground by switching of the transistors M3 and M4. Therefore, noise caused due to the spike current is superimposed on the ground. In the embodiment, however, since the impedance of the ground reaching from the terminal 922 to the LSI 500 is small, the influence of the noise can be suppressed to be small.

The invention is not limited to the above-described embodiment. For example, various modifications to be described below can be made. One aspect or a plurality of aspects of the selected modifications to be described can also be combined appropriately.

In the embodiment, the driving circuit 50 is configured to generate the modulated signal Ms and feed back the driving signal COM-A (COM-B) obtained by smoothing the amplified modified signal by the lowpass filter, but the modulated signal Ms may be feedback. For example, although not particularly illustrated, an error between the modulated signal Ms and the input signal As may be calculated, a signal delayed by the error and the signal Aa which is a target may be added or subtracted, and the result may be input to the comparator 520.

The amplified modulated signal appearing at the connection point (the pin Sw) of the transistors M3 and M4 is different from the modulated signal Ms merely in the logic amplitude. Therefore, for example, the amplified modulated signal may be feedback after being attenuated, as in the modulated signal Ms.

The four layers has been formed in the printed circuit substrate 90. However, six layers may be formed as well as the four layers. When six layers are formed in the printed circuit substrate 90, the feedback wiring pattern Fbl may be formed to be surrounded by a ground pattern in the fourth layer and the third and fifth layers may have a ground pattern. In this case, the second and sixth layers may have the ground pattern in addition to the third and fifth layers.

In the embodiment, the driving signals COM-A and COM-B of two systems separately generated by the two driving circuits 50 have been selected (or have not been selected) by the selection unit 230 to be supplied to one end of the piezoelectric element 60. However, for example, four trapezoid waveforms of a driving signal of one system may be repeated and any one trapezoid waveform or a plurality of combinations of the trapezoid waveforms may be supplied to one end of the piezoelectric element 60 according to the sizes of the dots defined by the data signals Data.

What is claimed is:

1. A liquid ejecting apparatus comprising:

a modulation circuit that generates a modulated signal obtained by performing pulse modulation on a source signal;

a transistor that amplifies the modulated signal to generate an amplified modulated signal;

a lowpass filer that smoothes the amplified modulated signal to generate a driving signal;

a piezoelectric element that is displaced when the driving signal is applied;

a cavity of which an internal volume changes through the displacement of the piezoelectric element;

a nozzle that is formed to eject a liquid in the cavity according to the change in the internal volume of the cavity; and a circuit substrate on which the modulation circuit, the transistor, and the lowpass filter are mounted, wherein the transistor includes a die that forms the transistor, the die has first and second surfaces opposite to each other, and the first surface faces the circuit substrate, a first electrode that is formed the first surface of the die, second and third electrodes that are formed on the second surface of the die, a conductive die pad that is electrically adhered to the first electrode, a first lead which is electrically connected to the second electrode by a bonding wire, and a second lead which is electrically connected to the third electrode by a bonding wire, wherein the die pad, the first lead, and the second lead are electrically connected to different wiring patterns of the circuit substrate, and wherein the first electrode, the die pad, and one of the different wiring patterns are stacked so that the first electrode is electrically connected to the one of the different wiring patterns.

2. The liquid ejecting apparatus according to claim 1, wherein a frequency of the modulated signal is equal to or greater than 1 MHz and equal to or less than 8 MHz.

3. The liquid ejecting apparatus according to claim 1, wherein in the circuit substrate, a through hole is formed in a region in which the transistor is mounted.

4. The liquid ejecting apparatus according to claim 1, wherein the modulation circuit feeds back a signal which is based on one of the modulated signal, the amplified modulated signal, and the driving signal to generate the modulated signal.

5. A head unit comprising:

a piezoelectric element that is displaced when a driving signal is applied;

a cavity of which an internal volume is changed through the displacement of the piezoelectric element; and a nozzle that is formed to eject a liquid in the cavity according to the change in the internal volume of the cavity, wherein the driving signal is a signal obtained when a lowpass filter smoothes an amplified modulated signal, wherein the amplified modulated signal is a signal obtained when a transistor amplifies a modulated signal, wherein the modulated signal is a signal obtained when a modulation circuit performs pulse modulation on a source signal, wherein the modulation circuit, the transistor, and the lowpass filter are mounted on a circuit substrate, wherein the transistor includes a die that forms the transistor, the die has first and second surfaces opposite to each other, and the first surface faces the circuit substrate, a first electrode that is formed on the first surface of the die, second and third electrodes that are formed on the second surface of the die, a conductive die pad that is electrically adhered to the first electrode, a first lead that is electrically connected to the second electrode by a bonding wire, and a second lead that is electrically connected to the third electrode by a bonding wire, wherein the die pad, the first lead, and the second lead are electrically connected to different wiring patterns of the circuit substrate, and wherein the first electrode, the die pad, and one of the different wiring patterns are stacked so that the first electrode is electrically connected to the one of the different wiring patterns.

6. A method of controlling a liquid ejecting apparatus including a piezoelectric element that is displaced when a driving signal is applied, a cavity of which an internal volume is changed through the displacement of the piezoelectric element, and a nozzle that is formed to eject a liquid in the cavity according to the change in the internal volume of the cavity, the method comprising:

mounting a modulation circuit, a transistor, and a lowpass filter on a circuit substrate;

generating, by the modulation circuit, a modulated signal by performing pulse modulation on a source signal;

generating, by the transistor, an amplified modulated signal by amplifying the modulated signal; and generating, by the lowpass filter, the driving signal by smoothing the amplified modulated signal, wherein the transistor includes a die that forms the transistor, the die has first and second surfaces opposite to each other, and the first surface faces the circuit substrate, a first electrode that is formed on the first surface of the die, second and third electrodes that are formed on the second surface of the die, a conductive die pad that is electrically adhered to the first electrode, a first lead that is electrically connected to the second electrode by a bonding wire, and a second lead that is electrically connected to the third electrode by a bonding wire, wherein the die pad, the first lead, and the second lead are electrically connected to different wiring patterns of the circuit substrate, and wherein the first electrode, the die pad, and one of the different wiring patterns are stacked so that the first electrode is electrically connected to the one of the different wiring patterns.

* * * * *